US006060655A

United States Patent [19]

Minamitaka

[11] Patent Number: 6,060,655

[45] Date of Patent: May 9, 2000

[54] APPARATUS FOR COMPOSING CHORD PROGRESSION BY GENETIC OPERATIONS

[75] Inventor: Junichi Minamitaka, Kokubunji, Japan

[73] Assignee: Casio Computer Co., Ltd., Tokyo, Japan

[21] Appl. No.: 09/307,437

[22] Filed: May 10, 1999

[30] Foreign Application Priority Data

May 12, 1998 [JP] Japan ..... 10-145138

[51] Int. Cl.[7] ..... C10H 1/36; C10H 5/00

[52] U.S. Cl. ..... 84/650; 84/669

[58] Field of Search ..... 84/613, 637, 650, 84/669

[56] References Cited

U.S. PATENT DOCUMENTS 4,539,882 9/1985 Yuzawa .

4,951,544 8/1990 Minamitaka .

FOREIGN PATENT DOCUMENTS 58-87593 5/1983 Japan .

2-197885 8/1990 Japan .

*Primary Examiner*—Jeffrey Donels

*Attorney, Agent, or Firm*—Frishauf, Holtz, Goodman, Langer & Chick, P.C.

[57] ABSTRACT

The present chord progression composer provides an open and wide space of composition and yet can compose those chord progressions having a desired valuation of fitness for a given melody. To this end, the composer receives an initial chord progression population. It computes melody fitness valuation of chord progression individuals of the population of interest. The chord progression population repeatedly undergo genetic operations (selection, crossover, mutation etc.). The melody fitness valuation will generally increase with generations under the control of the chord progression composer.

8 Claims, 21 Drawing Sheets

APPARATUS FOR COMPOSING CHORD PROGRESSION BY GENETIC OPERATIONS

BACKGROUND OF THE INVENTION

This invention relates to a computer-based music apparatus and systems for music composition, and more particularly to an automatic apparatus and method for composing chord progressions for melody harmonization.

An automatic chord progression composer or melody harmonizer is known which composes a chord progression to harmonize a given melody (for instance, Japanese Patent Application Laid-open Kokai Sho58-87593, U.S. Pat. No. 4,951,544, U.S. Pat. No. 4,539,882, and Japanese Patent Application Laid-open Kokai Hei2-197885).

For instance, an apparatus described in U.S. Pat. No. 4,951,544 subdivides a melody into a plurality of segments. It creates a number of chord candidates for a melody segment of interest based on pitch contents thereof. Then, it determines or selects one of the candidates as a chord for the melody segment according to music progression rules of tonal distance between one melody segment to another.

Either of the prior art chord progression composers, however, involves fixed rules or criteria for composing a chord progression. Thus, their process of composing a chord progression is completely or essentially deterministic for a given melody so that their composing capability is greatly limited.

SUMMARY OF THE INVENTION

Therefore, it is an object of the invention to provide an automatic chord progression composing apparatus and method which takes a new and unique approach for composing a chord progression to a melody.

Another object of the invention is to provide an apparatus and method which can efficiently compose a desired chord progression with melody fitness in accordance with a method of biological evolution involving stochastic processes.

In accordance with the invention, there is provided an apparatus for composing a chord progression which comprises;

(A) melody providing means for providing a melody;

(B) initial chord progression population providing means for providing a plurality of chord progressions as chord progression population of initial generation;

(C) chord progression evolving means for repeatedly generating a new generation chord progression population from an old generation one which starts with the initial generation;

(D) the chord progression evolving means comprising (i) chord progression evaluating means for evaluating individual chord progressions of a chord progression population of interest for the melody according to a predetermined function to thereby determine a melody fitness valuation thereof, and (ii) genetic operations means for performing generic operations on the chord progression population of interest so that the melody fitness valuation will generally get higher with generations changing from older to newer; and (E) stopping means for stopping the operation of the chord progression evolving means when a predetermined terminating condition is met.

With this arrangement, a chord progression population of a generation undergo genetic operations (e.g., selection, crossover, mutation). Their valuation of fitness for a given melody will generally get higher with generations changing from older to newer so that the chord progression population will experience desired evolution through a number of generations. Thus, the arrangement can efficiently compose such chord progression as having a desired melody fitness valuation. In addition, it can provide an open and wide space of a chord progression composition since the genetic operations on the chord progression population are not deterministic but involve stochastic processes.

In an embodiment, the genetic operations means comprises chord progression crossover means for exchanging chord progression segments between chord progression individuals of the chord progression population of interest. It may further comprise chord progression replacing means for receiving the resultant chord progression population from the chord progression crossover means and for replacing a chord progression individual having a lower melody fitness valuation with a chord progression individual of a higher melody fitness valuation. Since those chord progression individuals having a lower melody fitness valuation have been rejected from the next generation, the melody fitness valuation of the chord progression population will generally get higher.

In the alternative or in combination with the replacing means, a selection control means may be provided. The selection control means controls selective crossover frequency of chord progression individuals of the chord progression population of interest in such a manner that chord progression individuals are selected to undergo crossover at such a frequency as depends on melody fitness valuation thereof. With the selection control, those chord progression individuals of a generation having the highest melody fitness valuation get the highest chances of spreading out their genes (elements of chord progression) into the next generation. Thus, the melody fitness valuation of the chord progression population tends to get higher through generations.

The genetic operations means may further comprise mutation means for mutating an element of a chord progression individual.

The stopping means may comprise means for stopping the operation of the chord progression evaluating means when the melody fitness valuation of the chord progression population of interest has exceeded a predetermined value. In the alternative, the stopping means may stop the operation of the chord progression evaluating mean when it has repeated the genetic operations a predetermined number of times.

The invention further provides a method for automatically composing a chord progression for music harmonization, which comprises:

(A) a providing step of providing a melody;

(B) a providing step of providing a plurality of chord progressions as chord progression population of initial generation;

(C) an evolving step of repeatedly generating a new generation chord progression population from an old generation one which starts with the initial generation;

(D) the evolving step comprising (i) evaluating chord progressions of a chord progression population of interest for the melody according to a predetermined evaluating function to thereby determine a melody fitness valuation thereof, and (ii) performing genetic operations on the chord progression population of interest so that the melody fitness valuation will generally get higher with generations changing from older to newer; and (E) a stopping step of stopping the evolving step when a predetermined terminating condition is met.

Another aspect of the invention provides a method for automatically composing a chord progression for music harmonization, which comprises:

(A) a providing step of providing a melody;

(B) a providing step of providing a plurality of chord progressions as chord progression population of initial generation;

(C) a conditioning step of providing conditioning parameters;

(D) an evaluating step of evaluating fitness of individual chord progressions of a population of interest for the melody based on the conditioning parameters;

(E) a genetic step of performing genetic operations on the population of interest (starting with the initial generation) based on results of the evaluating to thereby generate a new generation of chord progression population; and (F) a repeating step of repeating the evaluating step and the genetic step until a predetermined terminating condition is met.

BRIEF DESCRIPTION OF THE DRAWINGS

The above and other objects and advantages of the invention will become more apparent from the following description taken in conjunction with the accompanying drawing in which.

DETAILED DESCRIPTION OF PREFERRED EMBODIMENT

The invention will be described in more detail with respect to the preferred embodiments.

Figure 1:
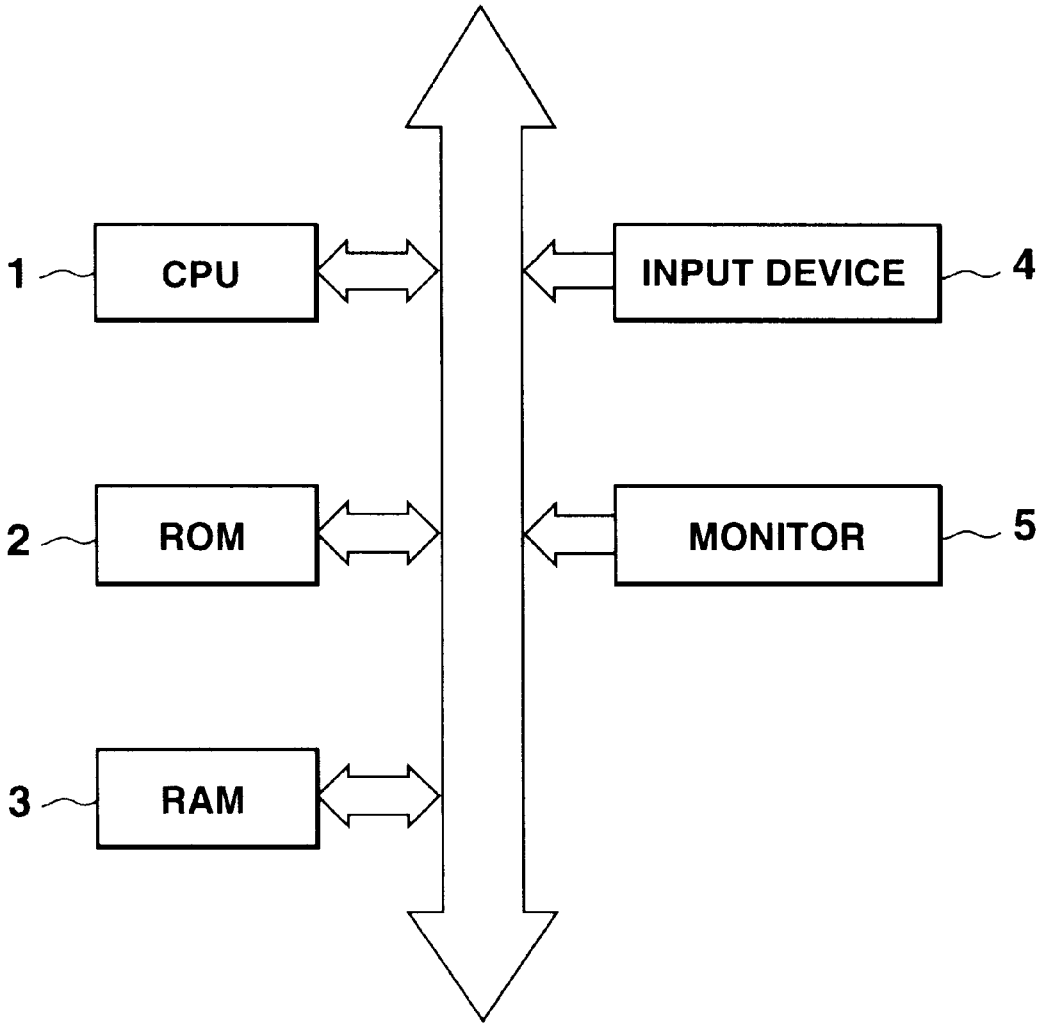
FIG. 1 is a block diagram showing a hardware arrangement of a chord progression composer in accordance with the invention.

FIG. 1 shows a hardware arrangement of a automatic chord progression composer of the invention. CPU 1 controls the system so as to function as a composer of the invention. ROM 2 stores programs and fixed data. RAM 3 is used as memory for storing data entered and those in process. An input device 4 is used to enter parameters required for composing chord progressions for melodies. A monitor 5 is used to display data, messages and information such as result of the chord progression composition and guide for input operation.

Figure 2:
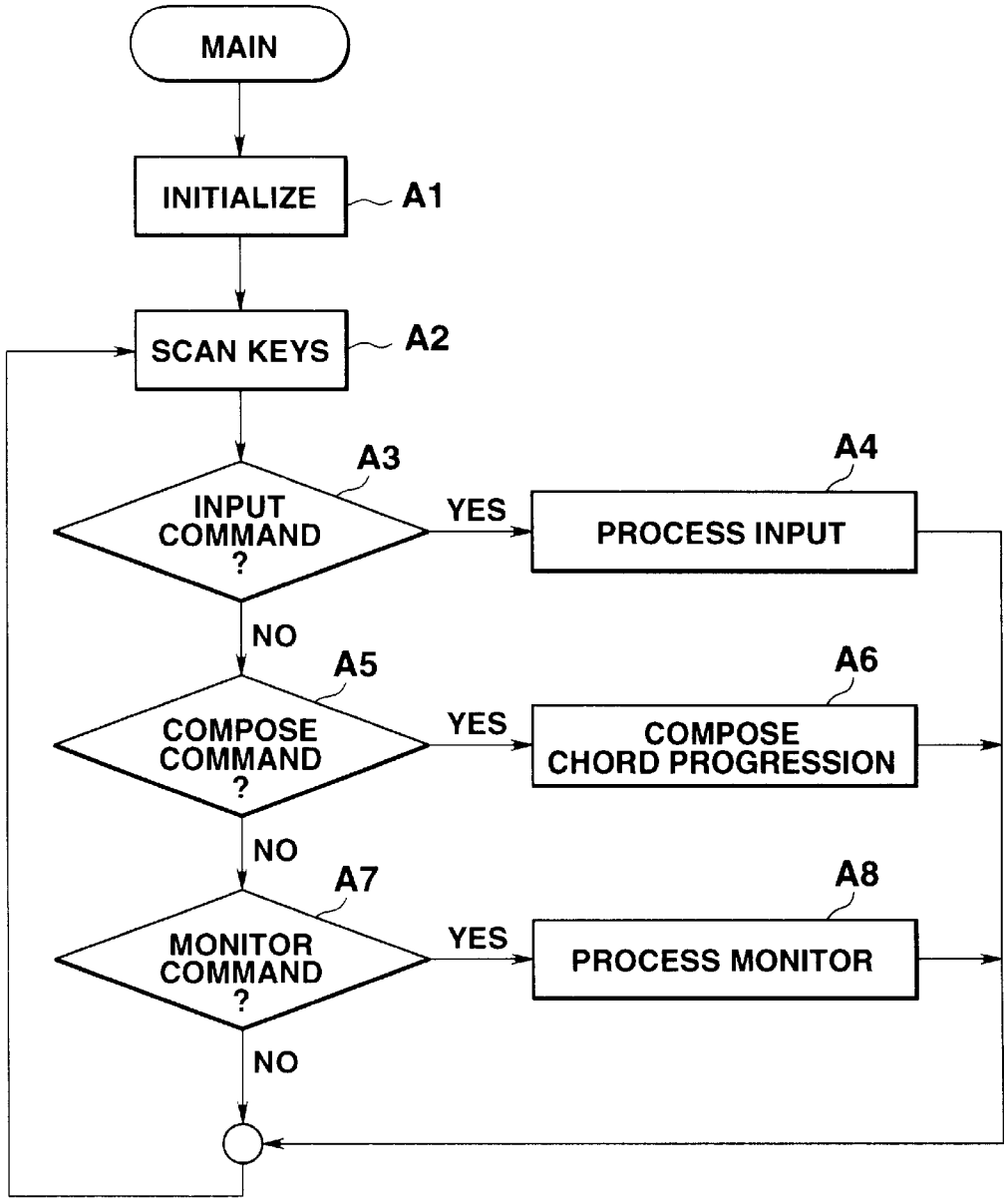
FIG. 2 is a main flow chart representing an overall operation of the chord progression composer in accordance with the invention.

FIG. 2 is a main flow chart showing the overall operation of the automatic chord progression composer. After initializing the system (A1), CPU 1 periodically scans keys of the input device 4 (A2) and performs a process according to a command from a user (A3 to A8). Specifically, in response to an input command (A3), it processes the input (A4). For a compose command (A5), a compose chord progression routine A6 is executed, whereas a process monitor routine A8 is invoked in response to a monitor command (A7).

Figure 3:
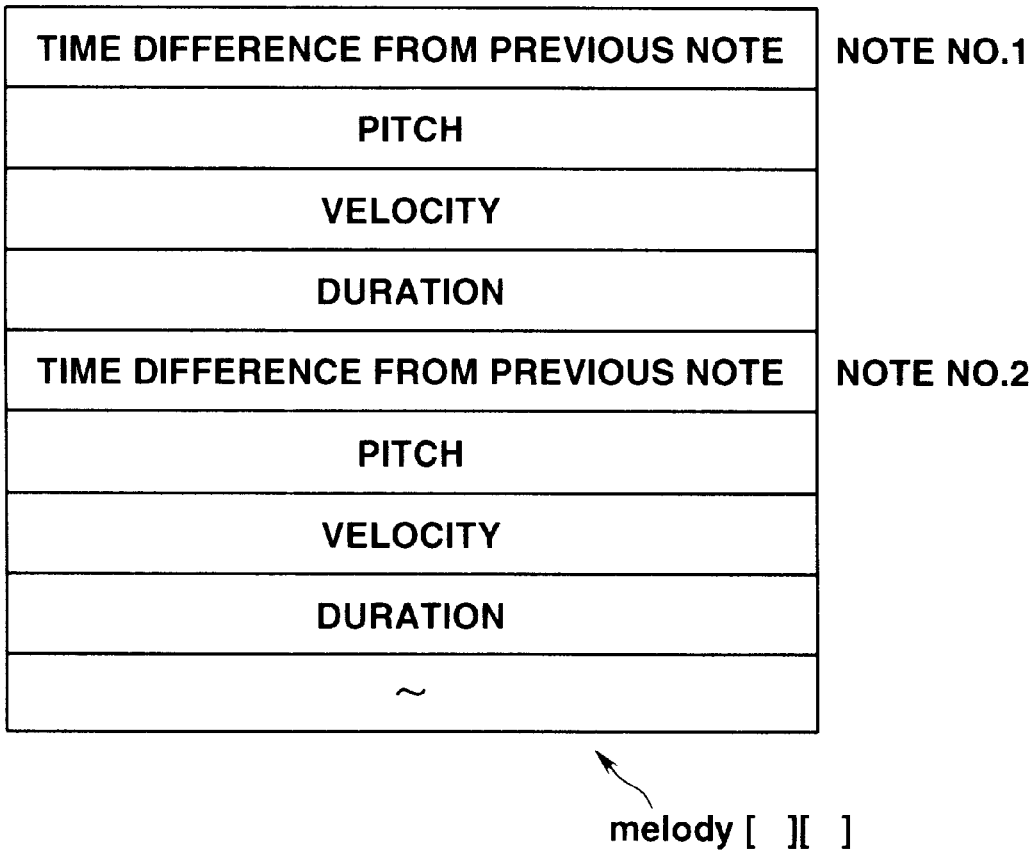
FIG. 3 illustrates a data structure of a melody.

FIG. 3 shows a data structure of a melody as melody [ ] [ ]. Melody data comprises a plurality of notes (note records). Each note record comprises the following data items; time difference from previous note (time data), pitch, velocity and duration. A note pointer np locates a note record (e.g., np=0 points to a first note) whereas an item pointer ip specifies a data item. Melody [np] [ip] represents a particular data item ip of a particular note np in the given melody.

Figure 4:
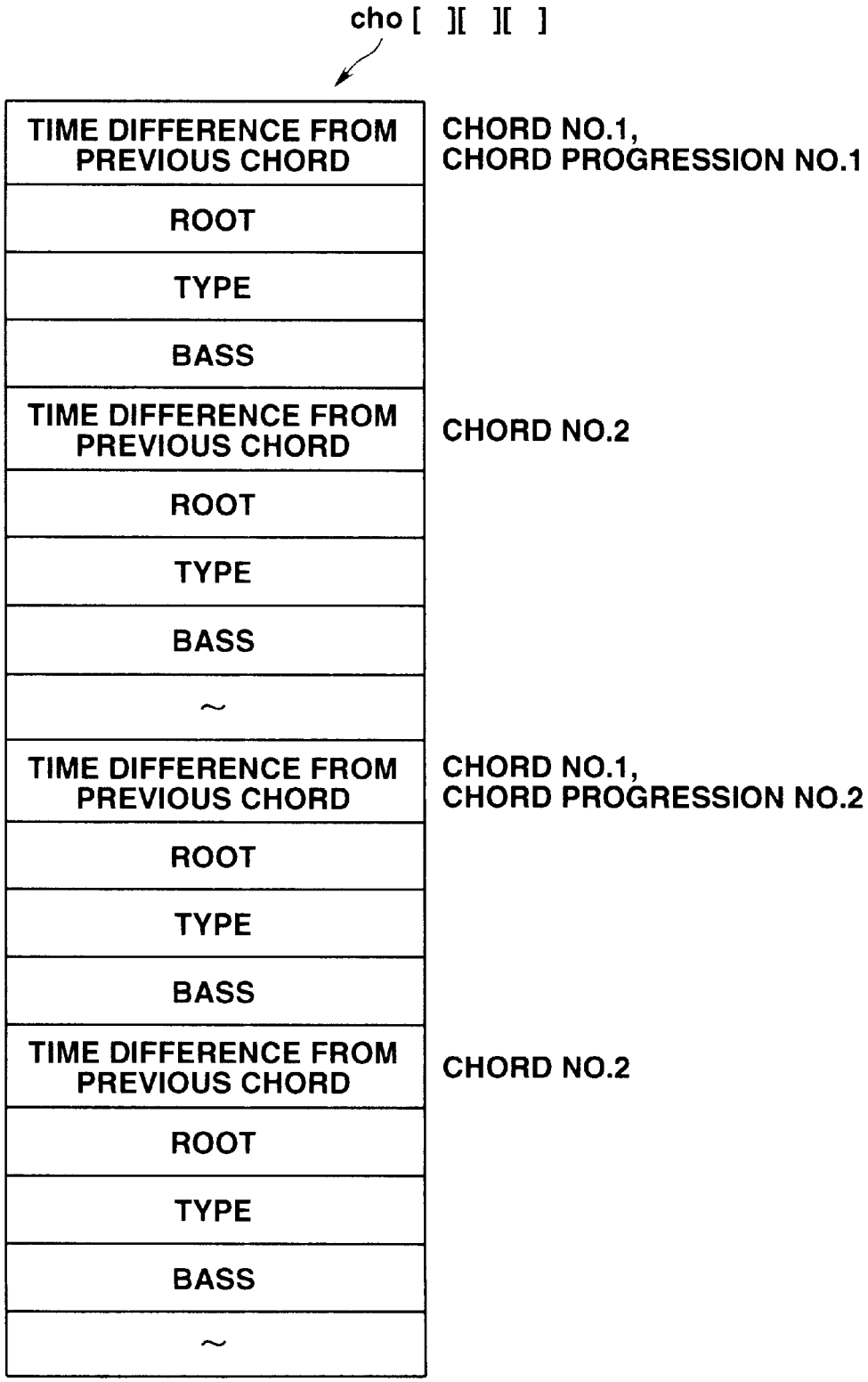
FIG. 4 illustrates a data structure of a chord progression population.

FIG. 4 shows a data structure of a chord progression population as cho [ ] [ ] [ ]. The chord progression population comprises a plurality of chord progressions. Each chord progression includes the following data items; time difference from previous chord (time data), root, type and bass. A chord progression pointer pp points to a chord progression in the population (e.g., pp=0 points to a first chord progression). A chord pointer cp locates a chord in the population. An item pointer i locates a data item of the chord. Therefore, cho [np] [cp] [i] represents a particular data item i of a chord cp in a chord progression pp in the given chord progression population.

Figure 5:
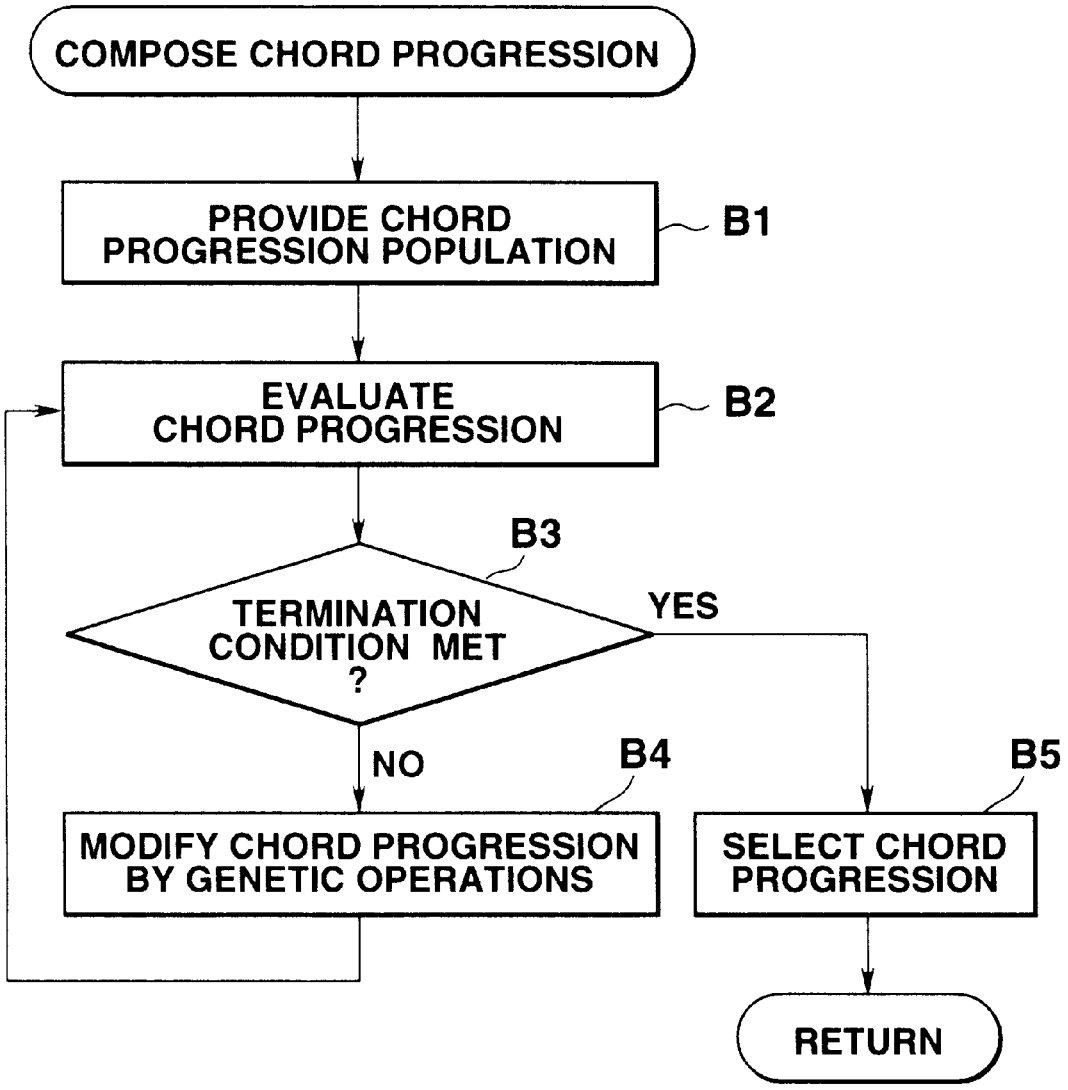
FIG. 5 is a flow chart of a compose chord progression routine involving genetic operations on the chord progression population in accordance with the invention.

FIG. 5 is a flow chart of the compose chord progression routine A6 in accordance with the invention.

At the beginning, a chord progression population of an initial generation is provided (B1). The initial chord progression population may be generated by random numbers (as will be described later) or may be preset in the system. Block B2 evaluates a chord progression for fitness for the given melody. The chord progression evaluation B2 will be described later in more detail. Block B3 checks if a termination condition is met for the chord progression. In the negative, the modification chord progression block B4 performs genetic operations on the chord progression population, thus generating the next generation of the chord progression population.

The terminating condition test block B3 may be realized by either a repeat count test for checking if the genetic operations B4 have been repeated a predetermined number of times, or a melody fitness test for checking if the fitness valuation of the chord progression population of interest has exceeded a predetermined value. The sum or an average of the individual valuations (each_val [pp]) of chord progressions of the population, or a maximum of the individual valuations (each_val [pp]) may be used as representative of the fitness valuation of the progression.

If the termination condition is met at B3, a chord progression selection block B5 determines or selects from the population of the final generation a chord progression which is to harmonize the given melody. This is done by selecting, for example, a chord progression having the maximum valuation of melody fitness (each_val [pp]) in the chord progression population of the final generation.

In place of the chord progression selection block B5, the monitor routine A8 may include a step in which the user may choose from the final generation the chord progression that harmonizes the melody.

Figure 6:
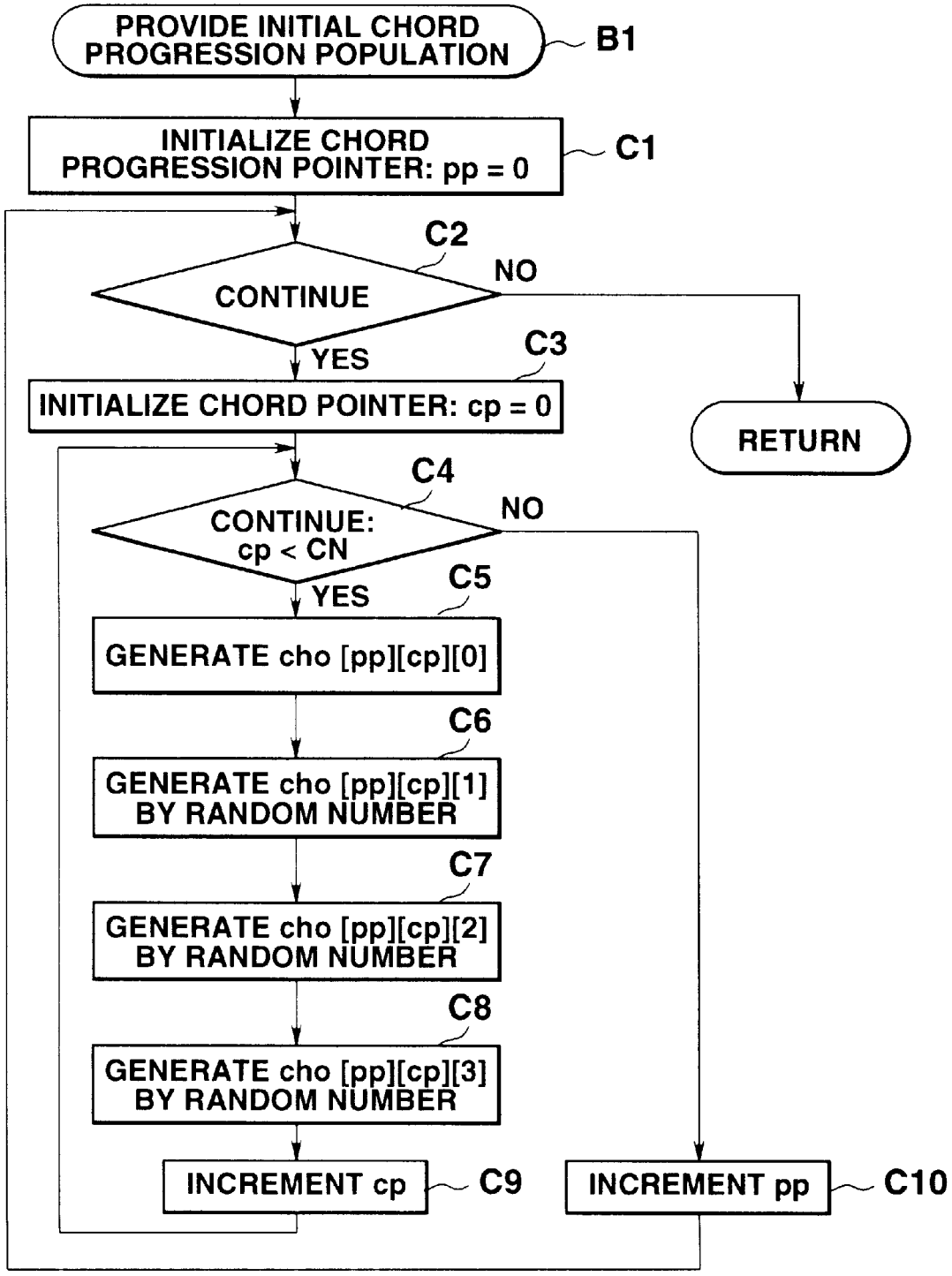
FIG. 6 shows a flow chart of a provide initial chord progression population routine.

FIG. 6 shows a flow chart of the routine B1 for providing or generating an initial chord progression population by random numbers.

Block C1 initializes the chord progression pointer pp to "0." Then, process from block C3 repeats until pp becomes a predetermined value (C2).

Block C3 initializes the chord pointer cp to "0." The process from block C5 repeats to make a chord progression having the length of the given melody (as checked by block C4). Block C5 generates time data cho [np] [cp] [0] from previous chord. The illustrated flow takes a length of a chord individual as one bar. Thus, for cp=0, the time data cho [np] [cp] [0] is set to "0" whereas it is set to "one bar length" for cp≠0. A variable chord length system may be used if desired. For example, a bar may have one, two or four chords by setting at random either a chord length to one bar, half of bar or quarter.

Block C6 generates a root cho [np] [cp] [1] of a chord cp by a random number.

Block C7 generates a type of the chord by a random number.

Block C8 generates a bass of the chord by a random number.

Block C9 increments the chord pointer cp.

If a chord progression having the length of the melody is obtained (NO at C4), block C10 increments the chord progression pointer pp.

The chord progression evaluation B2 in FIG. 5 evaluates individual chord progressions of a chord progression population of interest for the given melody according to a predetermined function to determine their melody fitness valuation.

Figure 7:
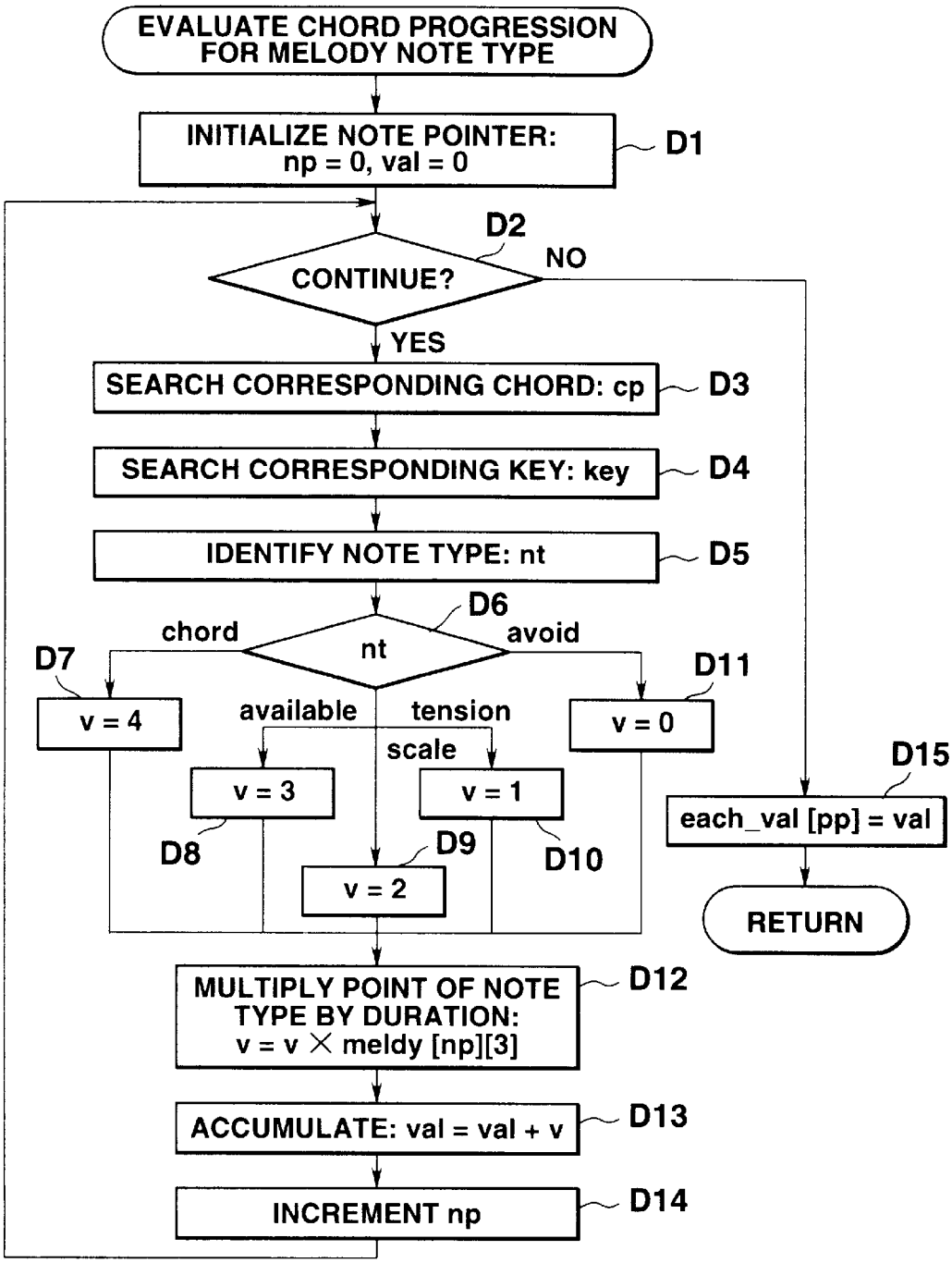
FIG. 7 is a flow chart of an evaluate chord progression routine.

FIG. 7 illustrates a routine of the chord progression evaluation B2 for melody note type.

The note type evaluation routine shown in FIG. 7 evaluates melody fitness of a chord progression in accordance with tonal harmony.

At first, block D1 initializes the melody note pointer np and an accumulator for melody fitness to "0."

Then, a loop of D3 to D14 repeats for np<the number of melody notes until block D2 finds the end of evaluating a chord progression.

Block D3 searches the chord progression pp to find a chord cp corresponding to the current note np.

Block D4 searches a key progression to find a "key" (called current key) of the current note np.

The next block D5 classifies or identifies a note type nt of pitch of the note (specified by the note pointer np) from the current key "key" and current chord (specified by pointer cp) information i.e., root and type. To this end, databases of chord tone, tension note, and scale note are used. The database of chord tone stores chord tones for chord types with root of C. The tension note database stores tension notes for chord types with root of C. The scale note database stores scale notes with key of C. For example, data in the chord tone database may be referenced by ct [type][pitch]. The data of "1" indicates a chord note whereas "0" indicates "non-chord tone".

A chord tone test is done as follow. For current chord root (cho [pp] [cp] [1]) and type (cho[pp] [cp] [2]), the current note pitch (melody[np] [1]) is identified as "chord tone" if ct [type] [(pitch+12−root) mod 12] is found "1." If it is found "0", the current note is declared "non-chord tone." Similarly, tn[type] [pitch] specifies data in the tension note database. A tension note test is done as follow. For current chord root and type, the current note of "pitch" is identified as "tension note" if tn [type] [(pitch+12−root) mod 12] is found "1." Else, it is declared "non-tension note." Similarly, sn[pitch] indicates data in the scale note database. A scale note test is done as follows. In the current key "key", the current note of "pitch" is identified as "scale note" if sn[(pitch+12−key) mod 12] is found "1." Else, it is declared "non-scale note."

The note type identification result (i.e., note type nt) of the block D5 is either CHORD TONE, AVAILABLE NOTE, SCALE NOTE, TENSION NOTE or AVOID NOTE. The result or conclusion of CHORD TONE is reached when the chord tone test has found "chord tone." The result of AVAILABLE NOTE is led by "tension tone" from the tension tone test and "scale note" from the scale note test. The note is identified as SCALE NOTE from the "scale note" and "non-tension tone." It is identified as TENSION NOTE from the "non-scale note" and "tension tone. If the note is not CHORD TONE, AVAILABLE NOTE, SCALE NOTE or TENSION NOTE, it is classified as AVOID NOTE.

Block D6 tests the note type nt. Blocks D7 to D11 give a point of V=4 for CHORD TONE, V=3 for AVAILABLE NOTE, V=2 for SCALE NOTE, V=1 for TENSION NOTE and V=0 for AVOID NOTE.

Block D12 multiplies the point of a note type by duration as V=V×melody [np][3].

Block D13 sums up the points by val=val+V.

Block D14 increments note pointer np before the routine returns to D2.

When block D2 finds np=the number of melody notes, block D15 is executed to obtain a chord progression valuation of melody fitness by setting each_val [pp]=val.

The flow of FIG. 7 is shown to determine a melody fitness valuation of a single chord progression pp. To evaluate all chord progressions of a chord progress population, the routine of FIG. 7 may be provided with an outer loop which increments the chord progression pointer pp from pp=0 to pp=(PN−1) where PN=the number of chord progressions of the population, thus repeating the routine of FIG. 7 as required.

The genetic operations of the modify chord progression block B4 are now described in detail.

Figure 8:
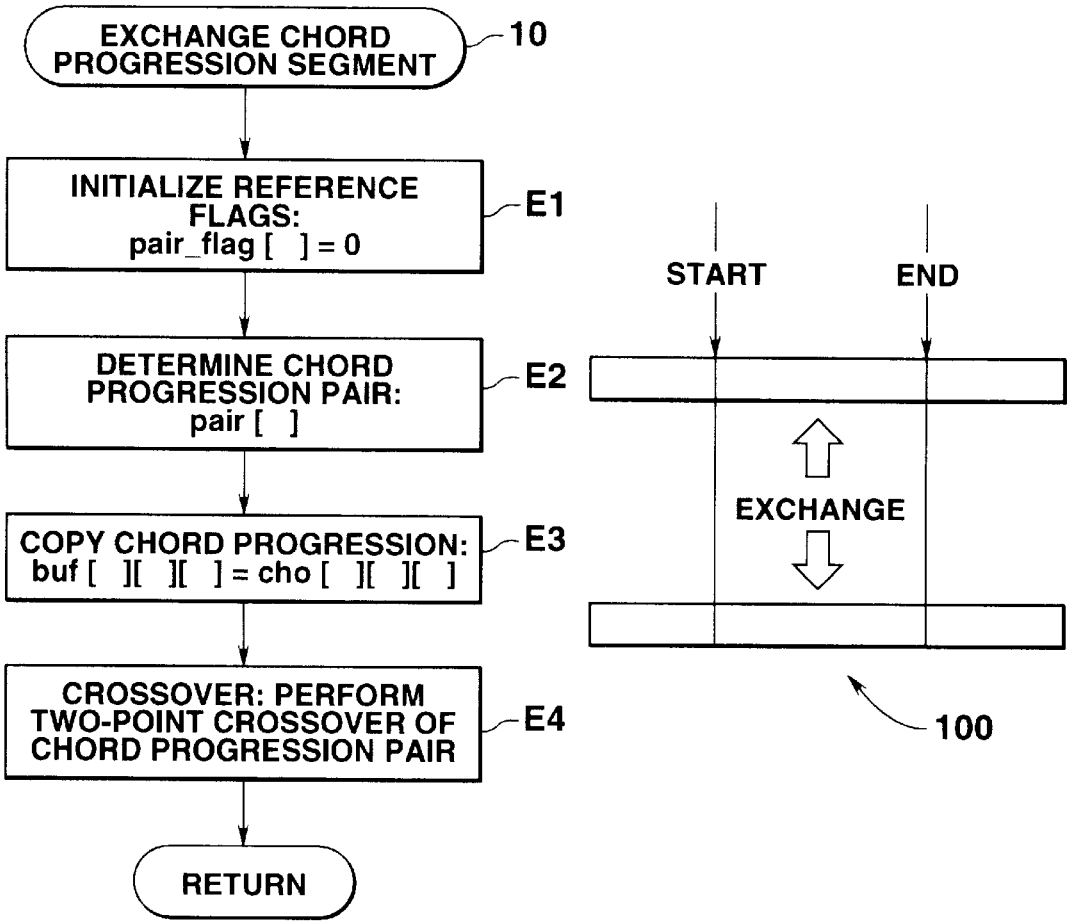
FIG. 8 is a flow chart of an exchange chord progression segments routine executed as part of the genetic operations.

FIG. 8 is a flow chart of an exchange chord progression segments routine as part of the genetic operations B4. The chord progression segment exchange routine selects from the chord progression population of interest chord progression pairs, one pair at a time, and performs crossover of the chord progression pair (exchange of chord progression segments) between the corresponding chord progressions, as designated by reference numeral 100. The illustrated crossover 100 is a two-point crossover. This is not limitative and any other suitable crossover can be performed in accordance with the invention.

For pairing chord progressions the routine initializes reference chord progression flags pairflag [ ] to "0" (E1), and determines at random chord progression pairs, one at a time (E2). Each time when having determined a chord progression pair, the block E2 turns on the corresponding reference chord progression flags so that they will not be selected again. Block E3 copies the chord progression population data into buffer buf [ ] [ ] [ ]. Then the crossover block E4 is executed to perform a two point crossover of respective chord progression pairs.

Figure 9:
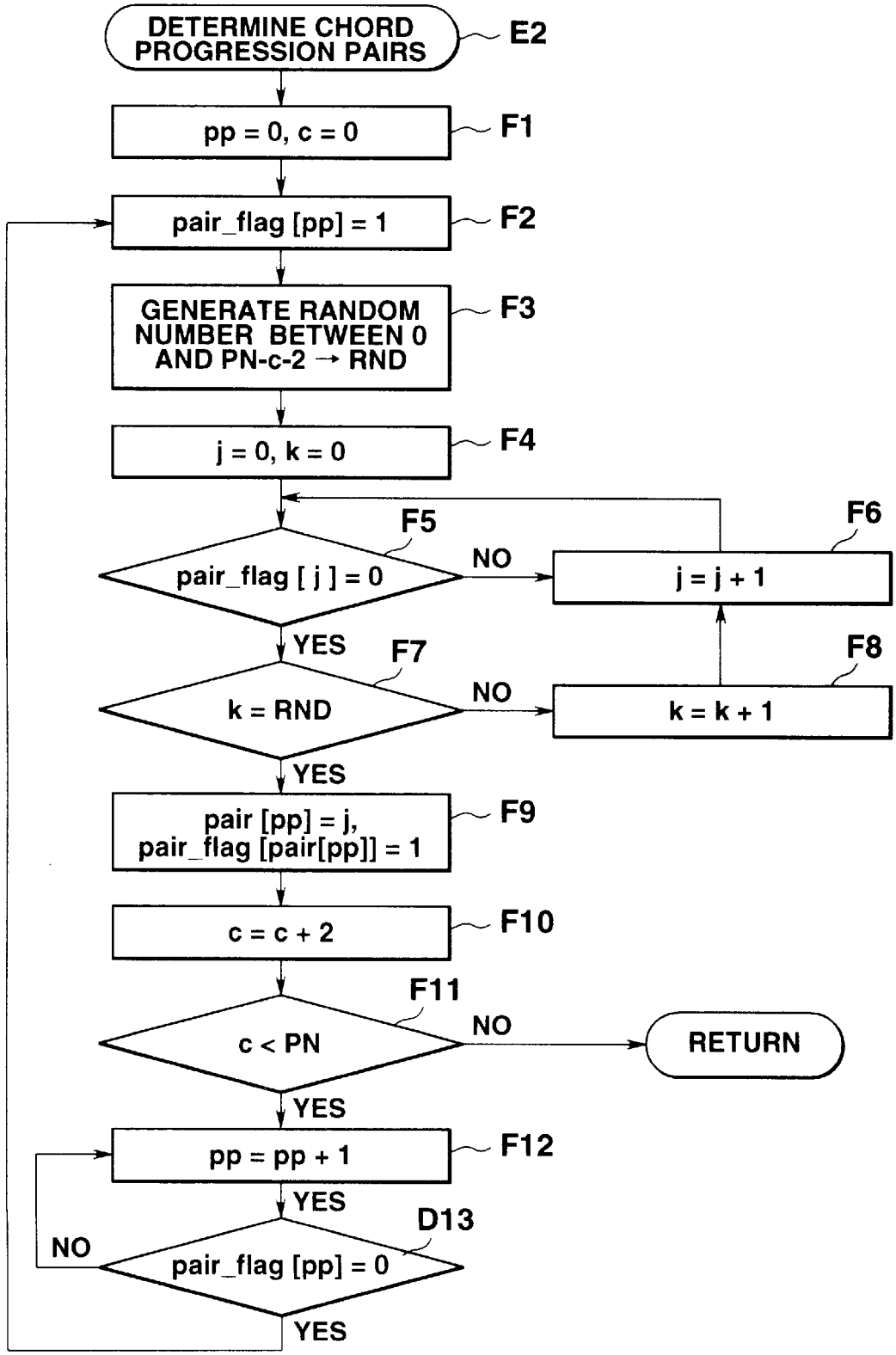
FIG. 9 is a flow chart of a determine chord progression pairs routine.

FIG. 9 is a detailed flow chart of the determine chord progression pairs block E2.

The entry block F1 initializes the chord progression pointer pp and counter c for counting chord progression that have taken part in chord progression pairing to "0." The block F2 turns on the current reference chord progression flag pairflag [pp] to "1." Then the determine chord progression pairs routine generates a random number RND (integer) between 0 and PN-C-2 and selects a chord progression corresponding to RND from those chord progressions which have not yet been paired with their reference flags pairflag [ ] of "0." The selected chord progression pair [pp] is a chord progression counterpart to be paired with the reference chord progression pp so that the selected chord progression flag pairflag [pair[pp]] is turned on (F3 to F9). Since a new pair of chord progressions has been determined, the routine increments the counter c by 2 to see whether it has reached PN (F10, F11). If this is not the case, there still remain chord progressions to be paired, so that the routine determines one of a chord progression pair, i.e., reference chord progression pp (F12, F13) and returns to the block F2.

Figure 10:
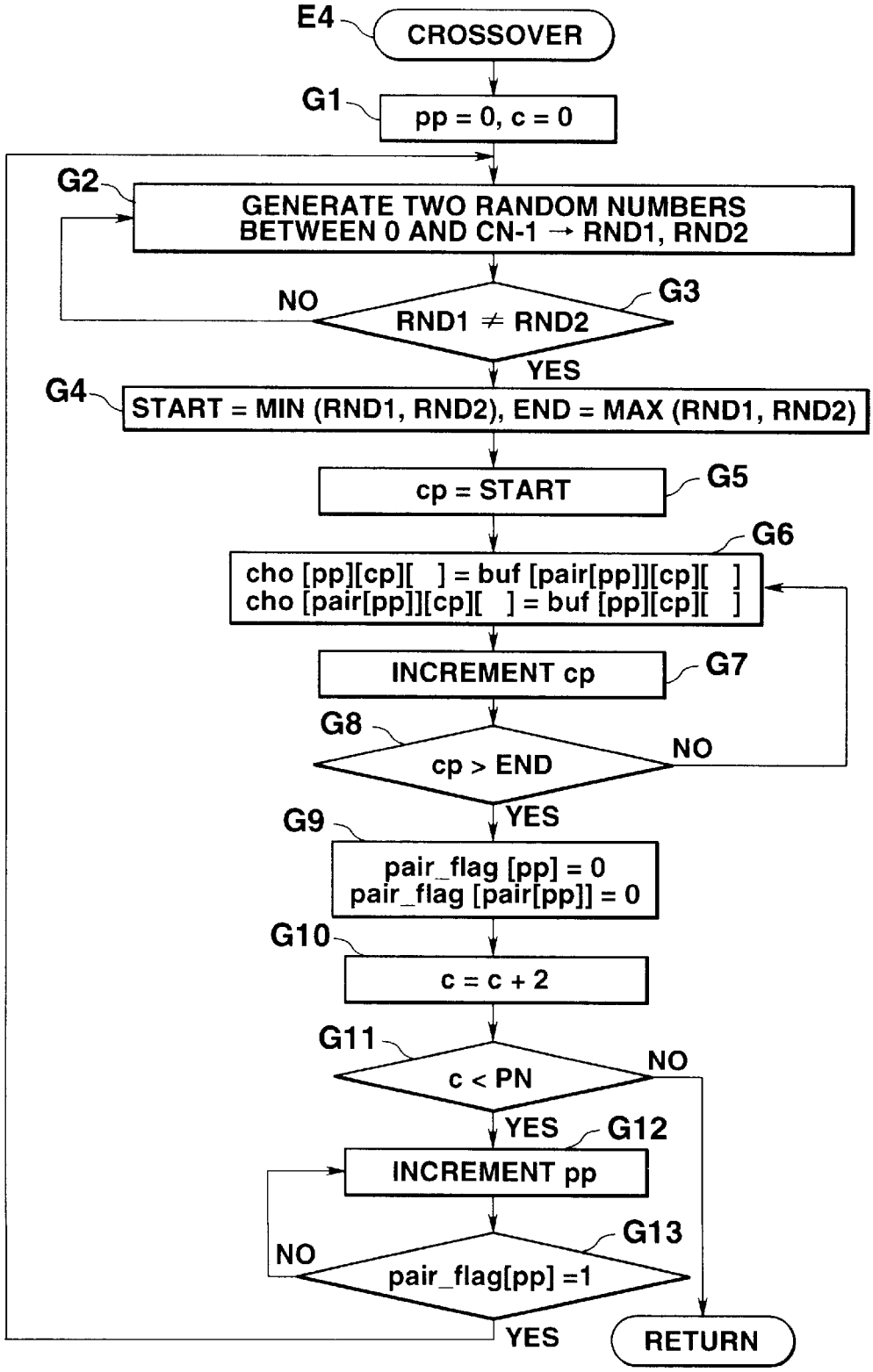
FIG. 10 is a flow chart of a crossover routine.

FIG. 10 is a detailed flow chart of the crossover routine E4.

At first, the routine initializes pp and counter c (used here for counting those chord progression which have undergone crossover) to "0" (G1), generates two different random numbers RND 1 and RND 2 between 0 to CN−1 (here, CN is the number of chord of chord progression), and selects the minimum of the random numbers as start point START of the crossover (exchange) and selects the maximum as the end point END of the crossover (G2–G4).

Then the routine initializes the chord progression pointer cp and performs exchange of chord progression segment data of corresponding chord progression of the chord progression pair from START to END, using the buffer (G5 to G11).

When the chord pointer cp reaches the end point END (YES at G8), the two-point crossover has been completed with respect to a chord progression pair of interest. Thus the routine turns off the flags of the chord progression pair to "0" (G9), increments the counter c by 2, and checks if all chord progression pairs have undergone crossover (G10, G11). If there still remains a chord progression pair to undergo crossing over, the routine selects the next reference chord progression pp (G12, G13) and returns to the block G2.

Figure 11:
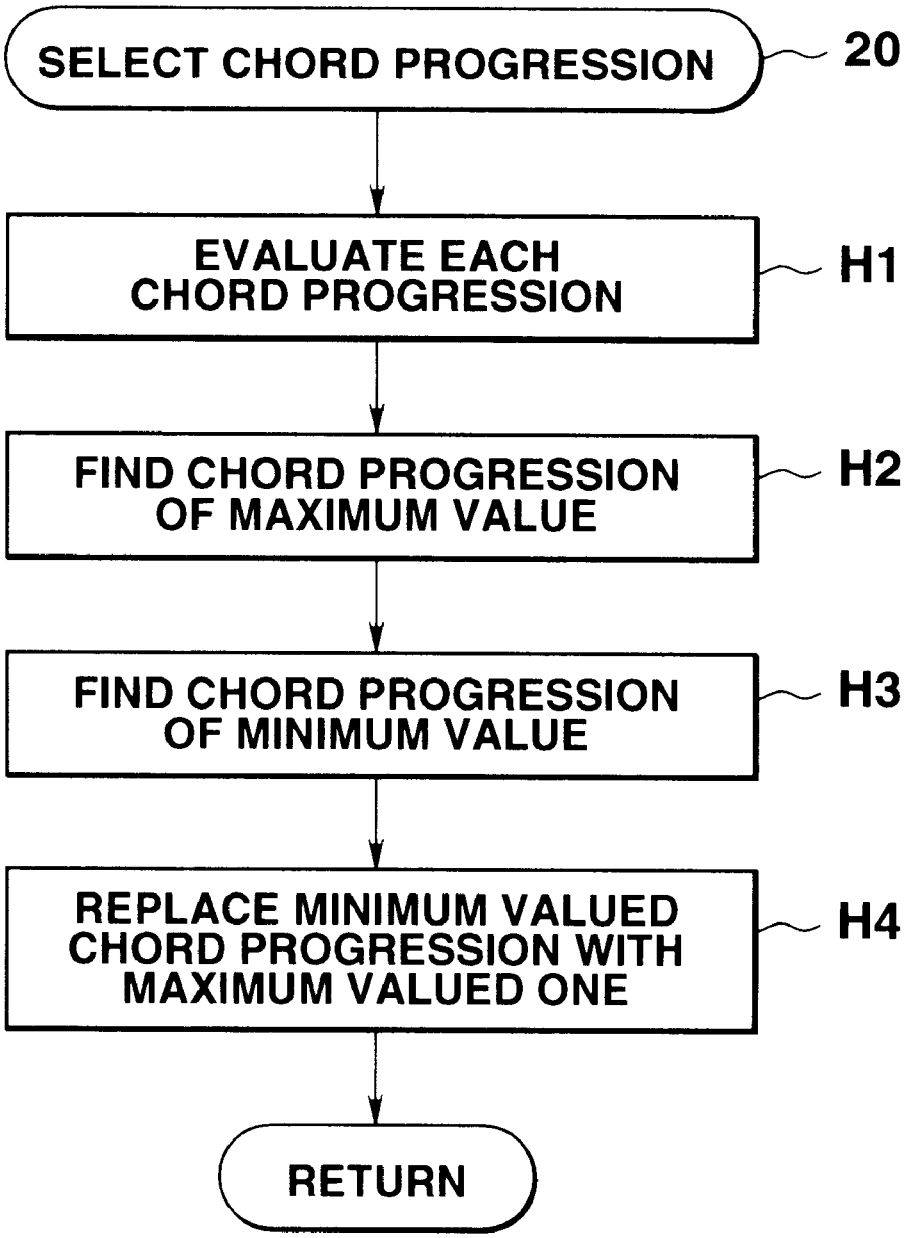
FIG. 11 is a flow chart of a select chord progression routine executed as part of the genetic operations.

FIG. 11 is a flow chart of a select chord progression routine 20 executed in the genetic operations block B4. This select chord progression routine 20 may preferably be executed after the chord progression crossover, such as the one 10 shown in FIG. 8, but could be performed at any stage of the genetic operations B4. In the following, it is assumed that the select chord progression routine is executed after the chord progression crossover.

In this case, the block H1 evaluates chord progression individuals of the chord progression population generated by the chord progression crossover.

The block H2 find a chord progression individual of the maximum valuation whereas the block H3 finds a chord progression individual of the minimum valuation. Then the block H4 replaces the minimum valued chord progression individual with maximum valued one.

In place of a single maximum or minimum valued chord progressions individual, a plurality of higher and lower valued chord progressions, for instance, the first to N-th highest valued chord progressions and first to N-th lowest valued chord progressions are looked up to replace such lower or lowest valued chord progression individuals with such higher or highest valued chord progression individuals.

The incorporation of the select chord progression routine 20 into the genetic operations block B4 will cause a descendent chord progression population to have a decreased number of lower valued chord progression individuals and an increased number of higher valued chord progression individuals. Thus, the melody fitness valuation of the chord progression population will generally get higher through generations by repeating the genetic operations B4.

With the chord progression segment exchange strategy 10, each and every chord progression individual of the chord progression population of interest is equally selected to undergo crossing over. In the alternative or in combination, another selection strategy, called value-dependent chord progression selection strategy may be adopted. For instance, the higher valued chord progression individual of the chord progression population of interest is controlled to get the higher chances or frequency of crossing over.

Figure 12:
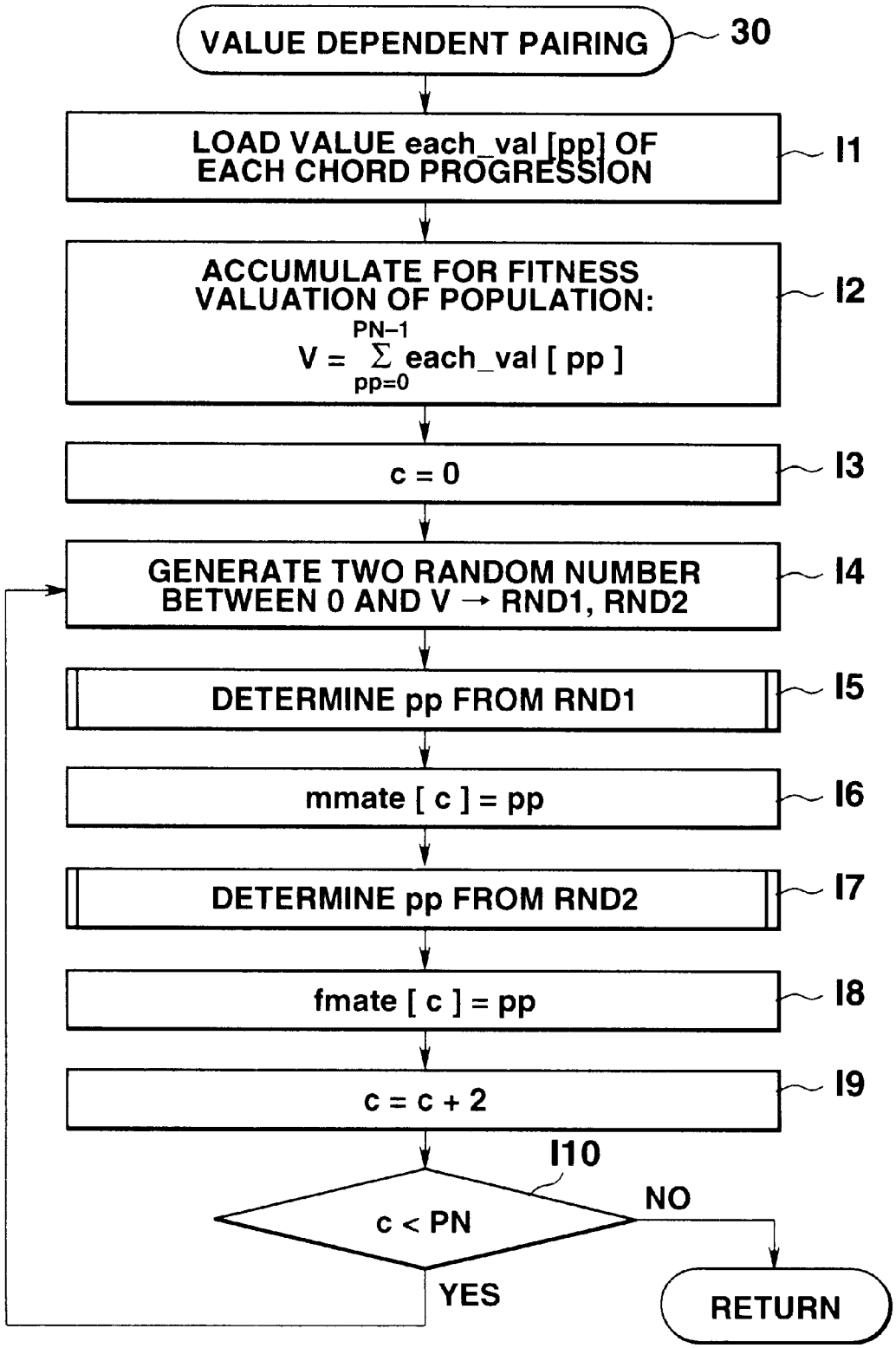
FIG. 12 is a flow chart of a value-dependent pairing routine for selecting from the population chord progression pairs for crossover according to their valuation of fitness.

FIG. 12 illustrates a flow chart of the value-dependent pairing, designated 30.

The first block I1 loads the valuation each_val [pp] of respective chord progression individuals. The block I2 accumulates them to get the chord progression valuation of the population. Block I3 initializes the chord progression counter c to "0" for counting chord progressions that have been paired or mated.

Then the routine generates two random numbers RND I and RND 2 (e.g., real numbers) between 0 and V (14), determines from RND 1 one of a chord progression pair, pp, declares it mmate [c] (I5, I6), determines from RND 2 the other of the chord progression pair, pp, and declares it fmate [c] (I7, I8).

Figure 13:
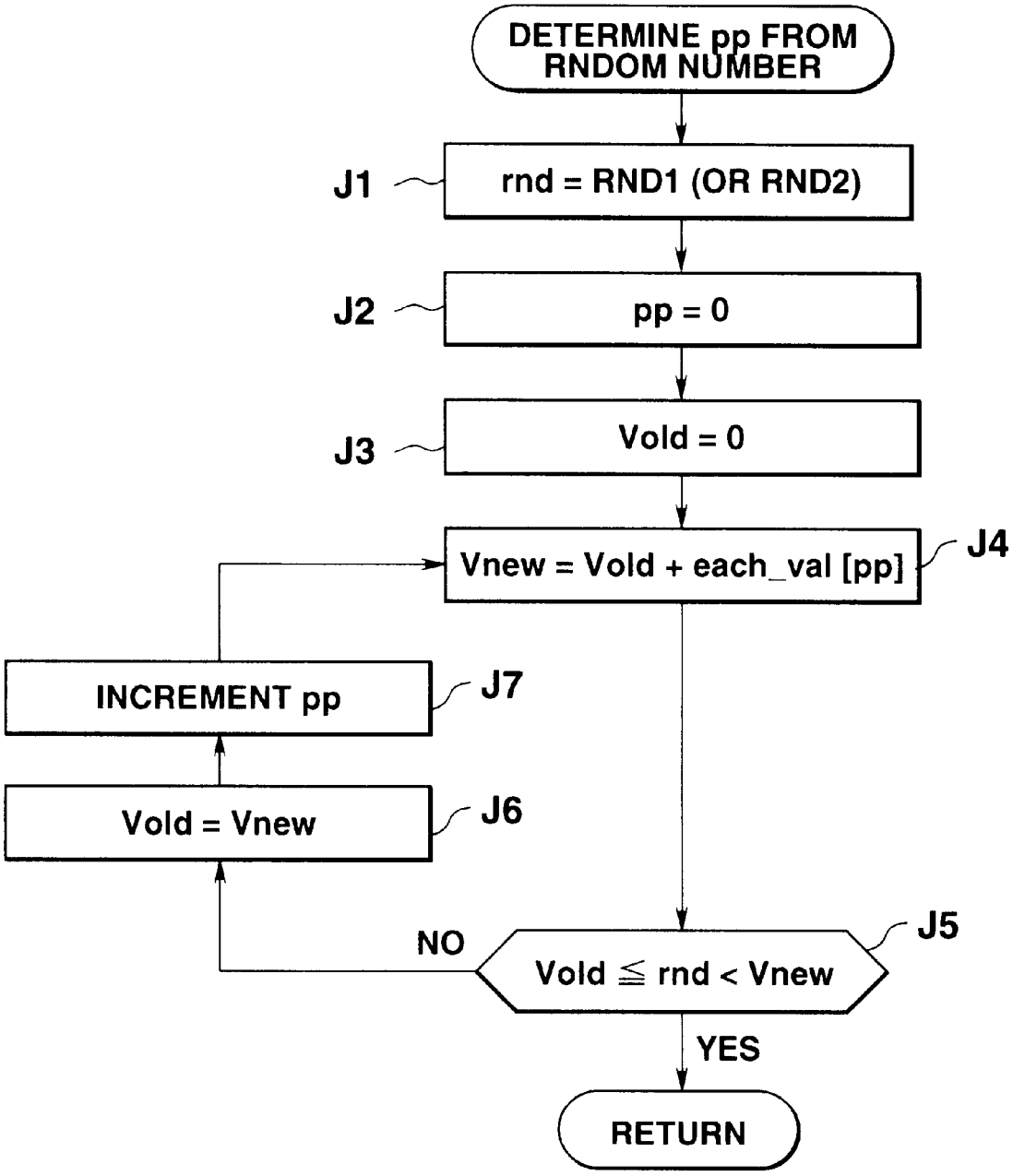
FIG. 13 is a flow chart of a routine for determining a chord progression (pp) from a random number.

FIG. 13 shows a detailed flow chart of the block I5 or I7 for determining a chord progression individual pp from the random number RND I or RND 2. The first block J1 sets RND 1 or RND 2 to rnd. Then, the chord progression pointer pp and Vold are initialized to "0" (J2, J3). The block J4 computes Vnew by $$\text{Vnew}=\text{Vold}+\text{each_val}[pp].$$

The block J5 tests the random number rnd to see whether it is in the range between Vold and Vnew, i.e., $$\text{Vold}\leq\text{rnd}<\text{Vnew}.$$

In the affirmative, the process returns to the block I6 or I8. In the negative, the routine sets Vcld to Vnew (J6), increments the chord progression pointer pp (J7) and returns to the block J4.

Turning back to FIG. 12, the block I9 increments the chord progression counter c by 2. Block I10 checks if there still remain chord progressions to be paired. If this is the case, the routine returns to the block I4.

In this manner, the value-dependent paring block 30 controls selection of chord progression individuals of the population in such a manner that a chord progression individual will take part in pairing as either mmate[ ] or fmate [ ] for crossover with a chance or frequency in proportion to its chord progression valuation of melody fitness, each_val[pp].

Figure 14:
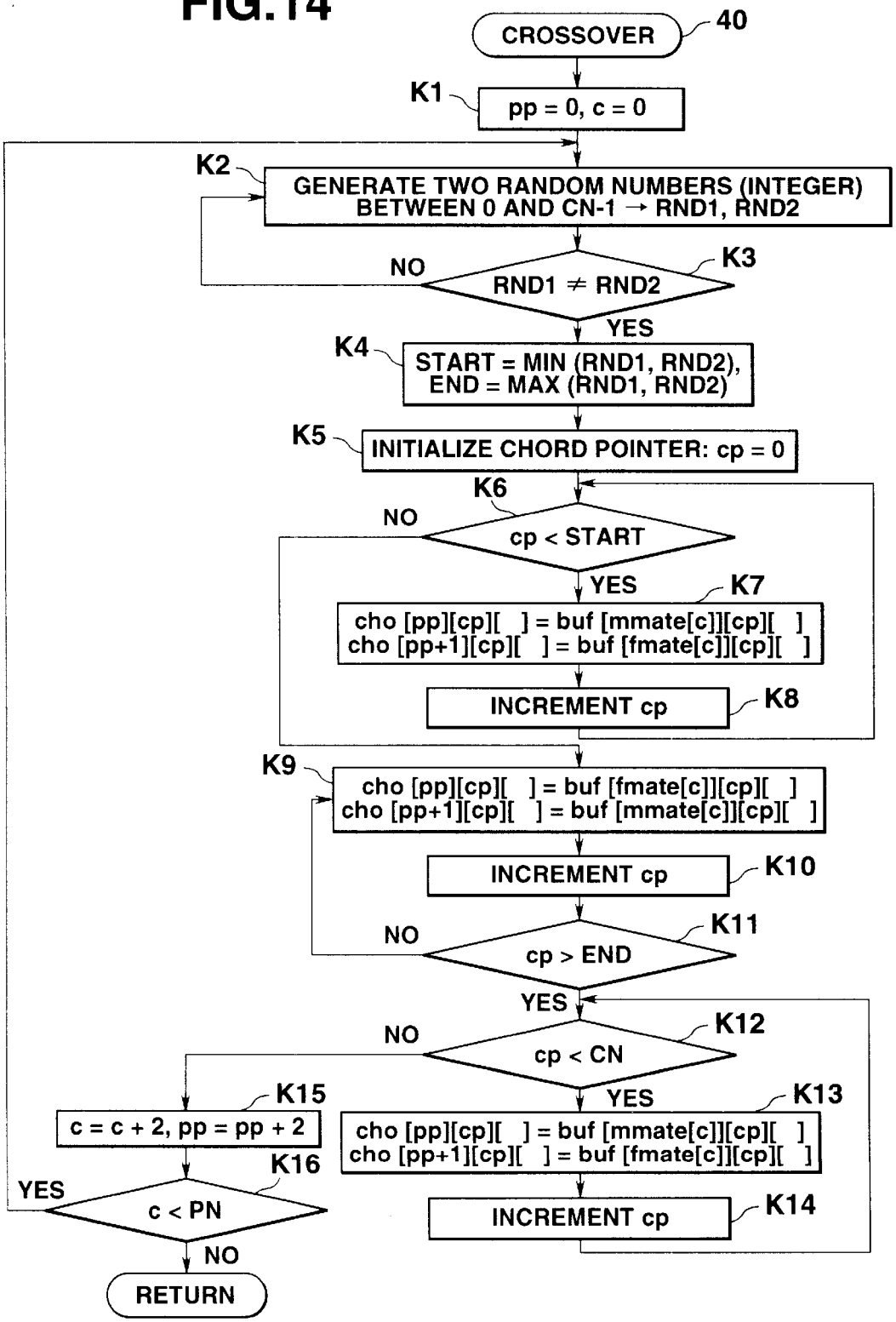
FIG. 14 is a flow chart of a crossover routine for performing crossover of the selected pairs.

FIG. 14 shows a flow chart of a crossover routine to be executed after the value-dependent paring 30. The chord progression data of the population are copied into the buffer (as done in the block E3 in FIG. 8) before the crossover process of FIG. 14.

The block K1 initializes pp and c to "0."

Then the routine generates two different random numbers RND1 and RND2 (integer) between 0 and CN−1 (here, CN is the number of chords of a chord progression), uses the lower one as the start point START of the crossover and uses the higher as the end point END of the crossover (K2 to K4).

At the blocks K5 to K14, the routine performs exchange of chord progression segment data between corresponding chord progression pair mmate [c] and fmatc [c], and stores the result as cho [pp] [cp] [ ] and cho [pp+1] [cp] [ ]. Specifically, when the chord pointer cp satisfies;

$$0 \leqq cp < START,$$

or $$END < cp \leqq NBEAT-1,$$

the routine executes the data transfer of:

cho [pp] [cp] [ ]=buf [mmate[c] [cp] [ ], and cho [pp+1] [cp] [ ]=buf [fmate [c]] [cp] [ ].

Thus, the buffer data at the location of chord progression mmate [c], chord pointer cp is loaded into the chord progression population memory as the data cho [pp] [cp] [ ] at the location of chord progression pp, chord pointer cp, whereas the buffer data at location of chord progression fmate[c], the chord pointer cp is loaded into the chord progression population memory as the data cho [pp+1] [cp] [ ] at the location of chord progression (pp+1) and chord pointer cp (K5 to K8, K12 to K14).

On the other hand, when the chord pointer cp satisfies;

$$START \leqq cp \leqq END,$$

the routine executes the data transfer of:

cho [pp] [cp] [ ]=buf [fmmate[c] [cp]] [ ], and cho [pp+1] [cp] [ ]=buf [mmate [c]] [cp] [ ].

Thus, not mmate [c] but fmate [c] supplies the data cho [pp] [cp] [ ] whereas not fmate [c] but mmate [c] supplies the data cho [pp+1] [cp] [ ]. In doing so, exchange of chord progression segments is performed.

When parent chord progression pair mmate [c] and fmate [c] have completed crossover, (i.e., have generated a chord progression pair of children), then the block K12 finds cp=CN (K12). Thus, the block K15 increments c and pp by 2. The block K16 checks if all pairs have completed crossover (c=PN). In the negative, the routine returns to the block K2.

As a result of the value-dependent pairing 30 and crossover 40 of chord progression pairs, those chord progression individuals of the parent population having the higher melody fitness valuation spread out their genes (chord progression elements) the more into a chord progression population of child generation. Thus, a child or descendent chord progression population will get a higher melody fitness valuation.

Figure 15:
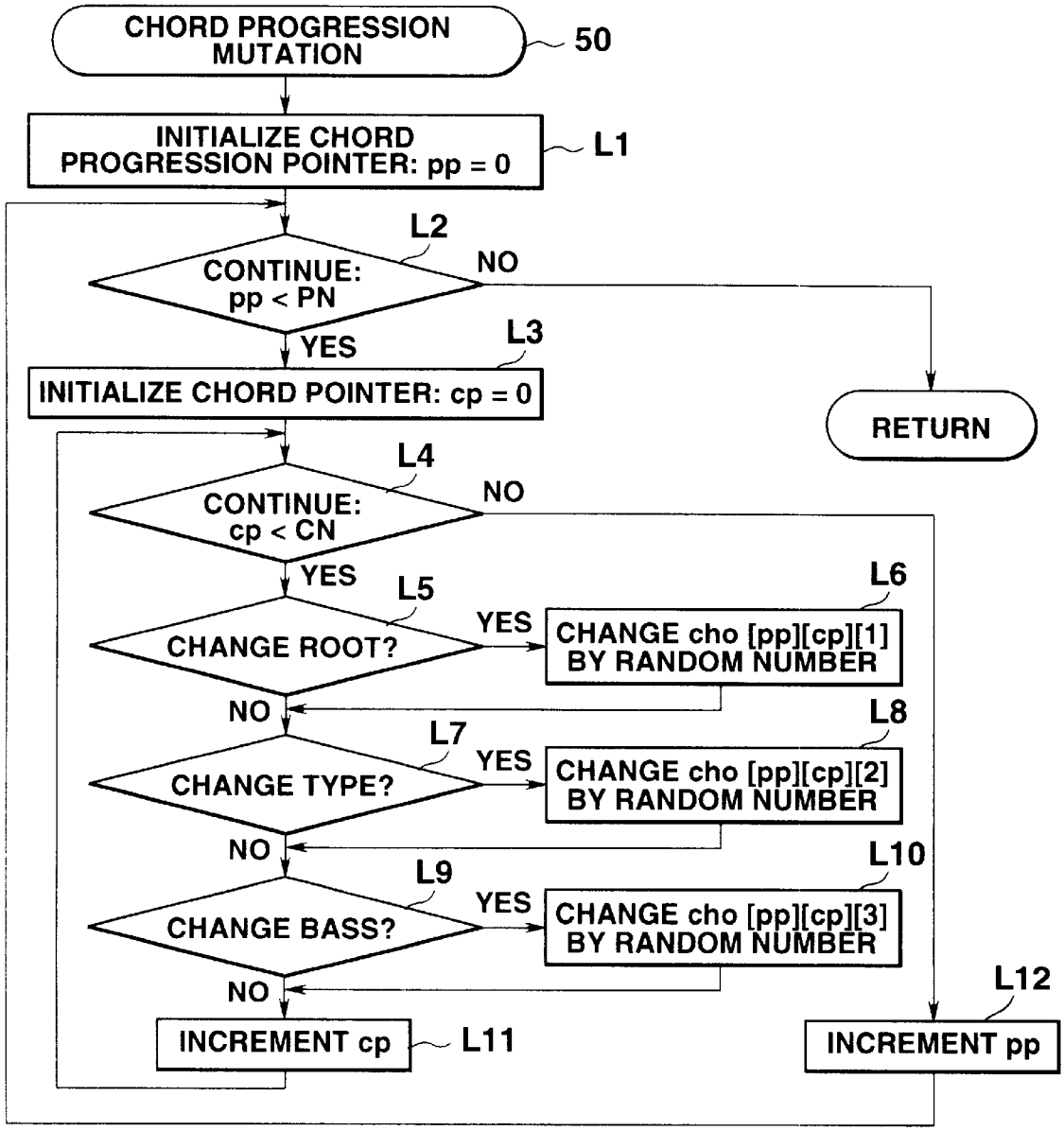
FIG. 15 is a flow chart of a chord progression mutation routine executed as part of the genetic operations.

FIG. 15 shows a flow chart of a chord progression mutation routine 50 executed as part of the genetic operations B4. The chord progression mutation 50 may be performed at any stage in the genetic operations B4.

The chord progression mutation routine 50 stochastically changes data of a chord of a chord progression individual. Specifically, in the example of FIG. 15, root, type or bass changes by chance whereas time data (time difference from previous chord) will not change.

The block L1 initializes the chord progression pointer pp to "0". Then, the routine performs a loop of L2–L12 until pp has reached PN (L2). The block L3 initializes the chord pointer cp to "0." The loop of L4–L11 repeats until cp has reached CN (L4). The condition of cp=CN causes incrementing the chord progress pointer pp (L12). The block L3 initializes the chord pointer cp to "0". Then, the loop of L4–L11 repeats until cp has reached CN (Q4). When cp=CN, the chord progression pointer pp is incremented (L12).

The blocks L5 to L10 constitute mutation of contents of a chord of the chord pointer cp. When a chord root is to be changed (YES at L5), the block L6 changes the root cho [pp] [cp] [1] of the chord by a random number. When a chord type is to be changed (YES at L7), the block L8 changes the type cho [pp] [cp] [2] by a random number. When a chord bass is to be changed (YES at L9), the block L10 changes the bass cho [pp] [cp] [3] by a random number.

After the mutation of chord contents, the routine increments the chord pointer cp (L11) and returns to the block L4.

Figure 16:
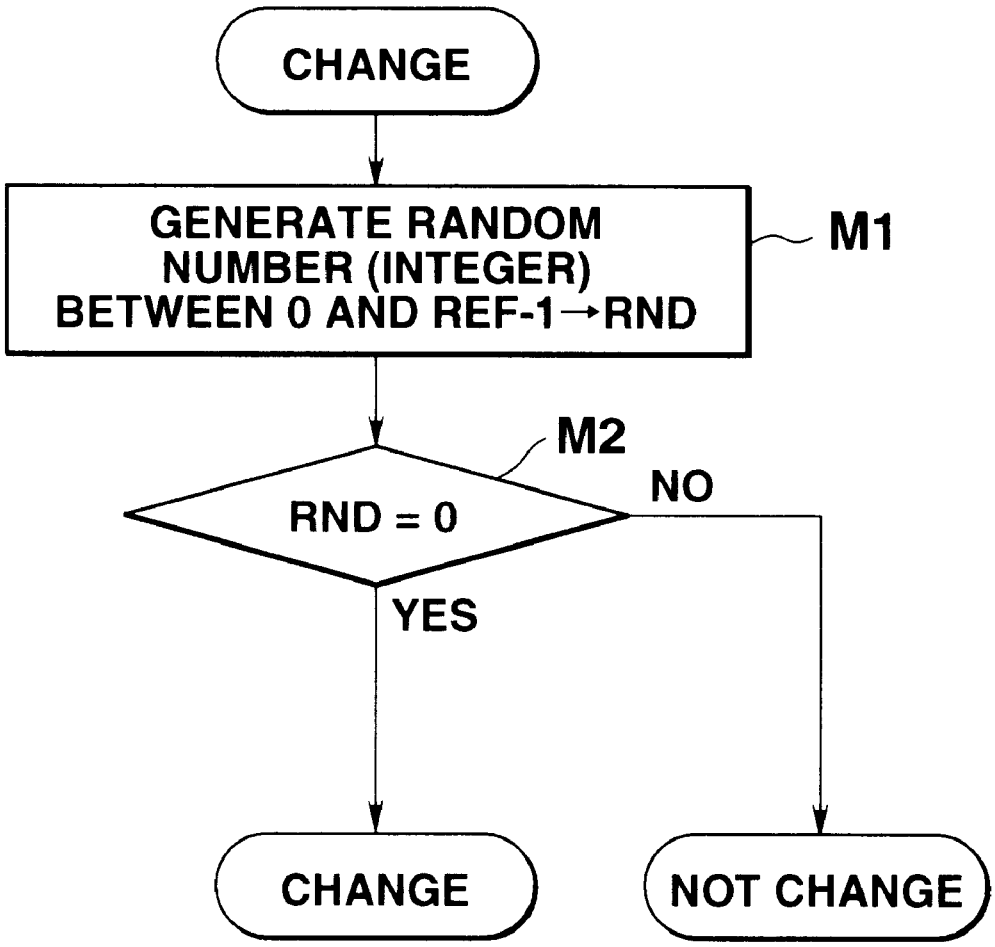
FIG. 16 is a flow chart of a routine for determining whether a chord data item is to be changed.

FIG. 16 shows a flow chart of the change check routine L5, L7 or L9 for checking if a data item of a chord is to be changed or not. The block M1 generates a random number (integer) RND between 0 and (REF−1). If RND=0 (M2), the routine determines "change", otherwise it determines "not change." Thus, RND=0 occurs at the probability of 1/REF (predetermined integer).

Figure 17:
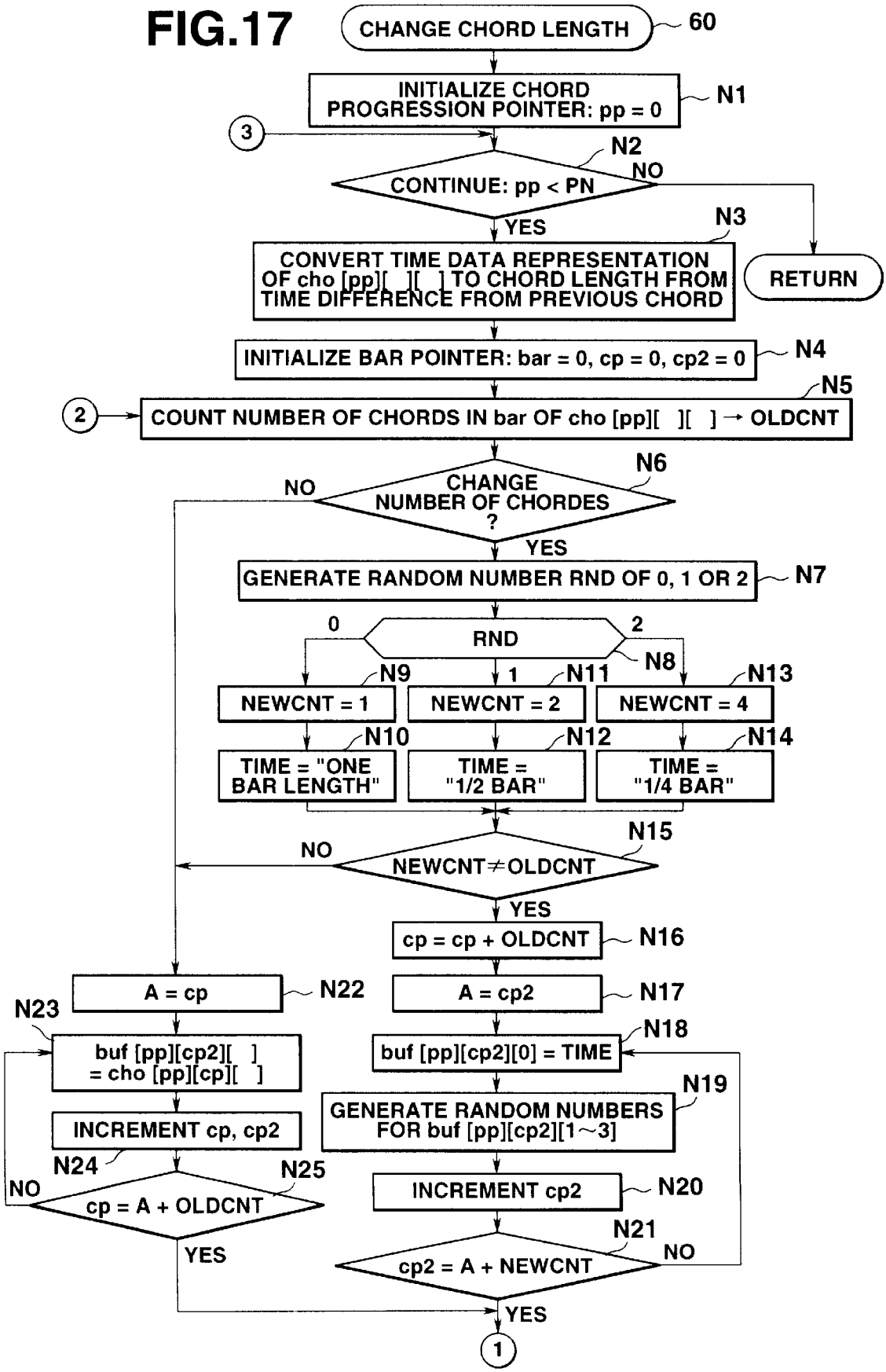
FIGS. 17 and 18 are flow charts of a change chord-length routine executed as part of the chord progression mutation routine.
Figure 18:
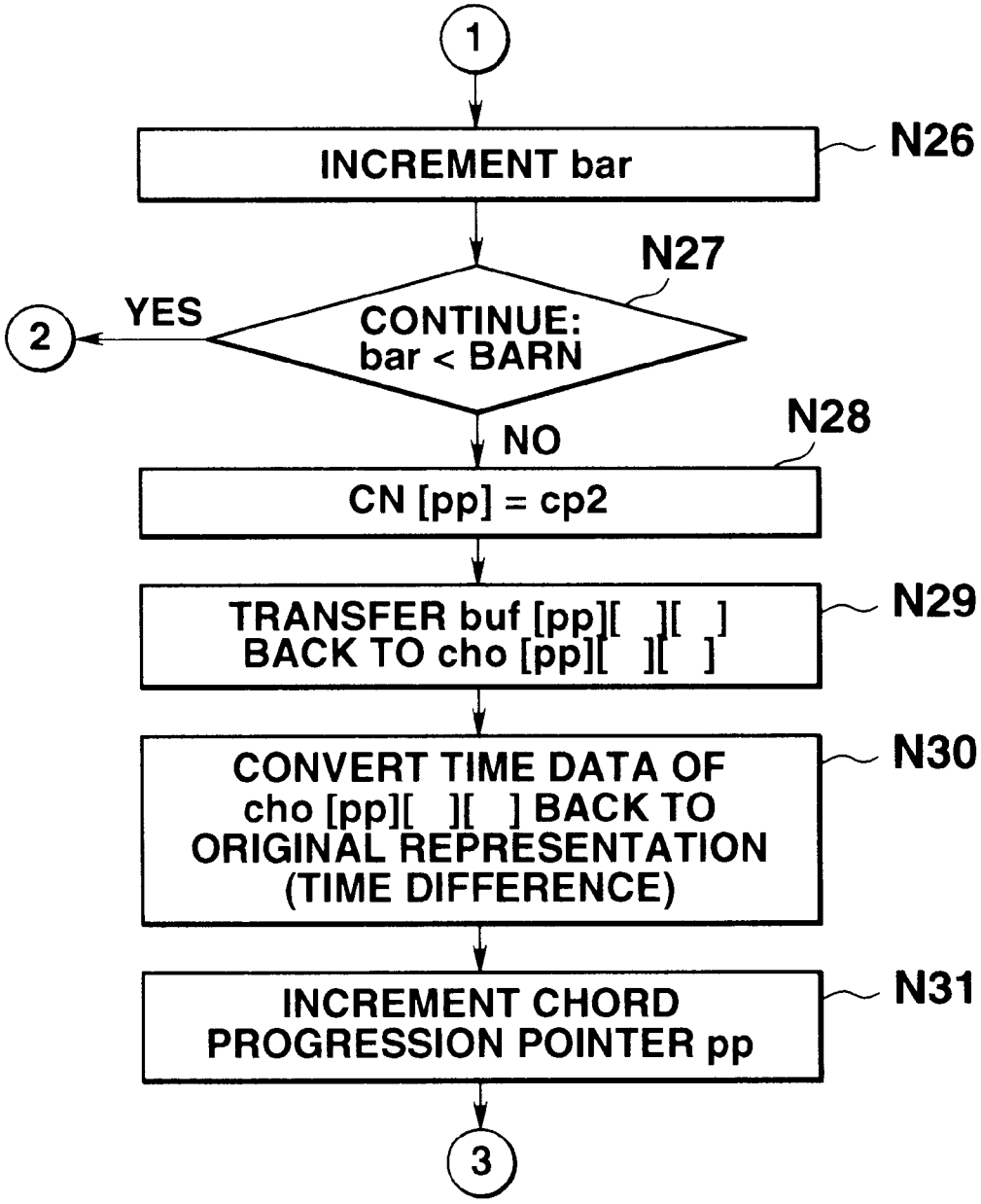

As described above, a chord length of a chord progression may be made variable. For example, a bar may includes one, two or four chords. For such a variable chord length system, a change chord length routine may be provided as part of the mutation of a chord progression. FIGS. 17 and 18 illustrate flow charts of the change chord length routine, designated by reference numeral 60.

The block N1 initializes the chord progression pointer pp to "0". If pp<PN (the number of chord progressions of the population) at N2, the routine executes blocks N3 to N30 to change the length of chords of the chord progression pp.

In the original data representation, time data of cho [pp] [ ] [ ] represents a time difference from a previous chord, as seen in FIG. 4. The change chord length routine uses a chord length as time data. To this end, the block N3 converts the time data represention of cho [pp] [ ] [ ] to "chord length."

The block N4 initializes a bar pointer bar to "0." It also initializes a chord pointer cp for cho [pp] [ ] [ ] and a chord pointer cp2 for a buffer buf [pp] [ ] [ ] to "0." The buffer buf [pp] [ ] [ ] is used to temporarily store data of the chord progression pp with the chord length changed by the routine.

According to the illustrated flow, the routine can change the number of chords per bar on a bar-by-bar basis.

To this end, the block N5 counts chords in bar of cho [pp] [ ] [ ] and declares the result OLDCNT.

Block N6 stochastically determines whether the number of chords in bar is to be changed in the manner shown in FIG. 16.

When the number of chords of the bar is to be changed, a random number RND (0, 1 or 2) is generated (N7). If RND=0 (N8), the number of chords of bar is set to one (NEWCNT=1) with the chord length of one bar (TIME="one bar"). If RND=1, the number of chords of bar is set to two (NEWCNT=2) with the chord length equal to half of bar (TIME="half of bar"). For RND=2, the number of chords of bar is set to four (NEWCNT=4) with the chord length of quarter of bar (TIME="quarter of bar"), as shown in blocks N13 and N14.

The block N15 compares NEWCNT with OLDCNT. If NEWCNT≠OLDCNT(N15), the block N16 to N21 are executed to creat a chord progression of the bar and store it into the buffer buf [pp] [ ] [ ]. Specifically, the routine creates chords as many as the NEWCNT, as the chord progression of the bar. Each chord length is set to TIME (buf [pp] [cp2] [0]=TIME) at block N18. Each chord root, type and bass are generated at random (see block N19; generate random numbers for buf [pp] [cp2] [1 to 3]).

In place of generating at random root, type and bass for all chords, the block N19 may be modified so as to generate data of those chords only which are to be added to the old chords. Specifically, if OLDCNT>NEWCNT, the modified block may select, from the contents (root, type and bass) of the bar of the chord progression cho [pp] [ ] [ ], data of chords as many as the NEWCNT and copy them into buf [pp] [ ] [ ]. For NEWCNT>OLDCNT, it may use data (root, type and bass) of chords from the bar contents of the cho [pp] [ ] [ ] as many as the OLDCNT and generate additional data (root, type and bass) of chords as many as the number of chords (NEWCNT-OLDCNT) to be added.

A chord length TIME is selected at random from a plurality of possible lengths (e.g., 1 bar, ½ bar, ¼ bar). If desired, the possible lengths may be controlled to occur at probabilities different from one another.

When block N21 finds cp2=A+NEWCNT, the pointer cp2 locates a first chord in the next bar of the buffer buf [pp] [cp2] [ ]. Block N16 sets the chord pointer cp to cp+OLDCNT, so that cp locates a first chord in the next bar of the buffer buf [pp] [cp] [ ].

If the number of chord is determined unchanged at N6 or if NEWCNT is found equal to OLDCNT at N15, the chord progression data of the bar of cho [pp] [cp] [ ] is copied into the buffer buf [pp] [cp2] [ ] (N22 to N25).

Block N26 increments the bar. If bar<BARN (the number of bars of the chord progression, and also that of the melody) at block N27, the routine returns to block N5 since there still remains a bar to be processed.

When bar has reached BARN at N27, the buffer buf [ ] [ ] [ ] has stored a chord progression pp having their chord lengths changed. Now cp2 represents the updated number of chords of the chord progression pp. Thus, the block N28 sets a number-of-chords variable CN [pp] to cp2.

The data buf [pp] [ ] [ ] of the chord progression pp produced on the buffer is transferred back to cho [pp] [ ] [ ] at block N29. Block N30 converts time data of cho [pp] [ ] [ ] back to the original representation i.e., time difference from previous chord.

The change chord length routine has now completed the process for chord progression pp. Thus, it increments the chord progress pointer pp at N31 and returns to N2 to repeat the process for the next chord progression.

A crossover routine for crossover of chord progression pairs for a variable chord length system will be described.

Figure 19:
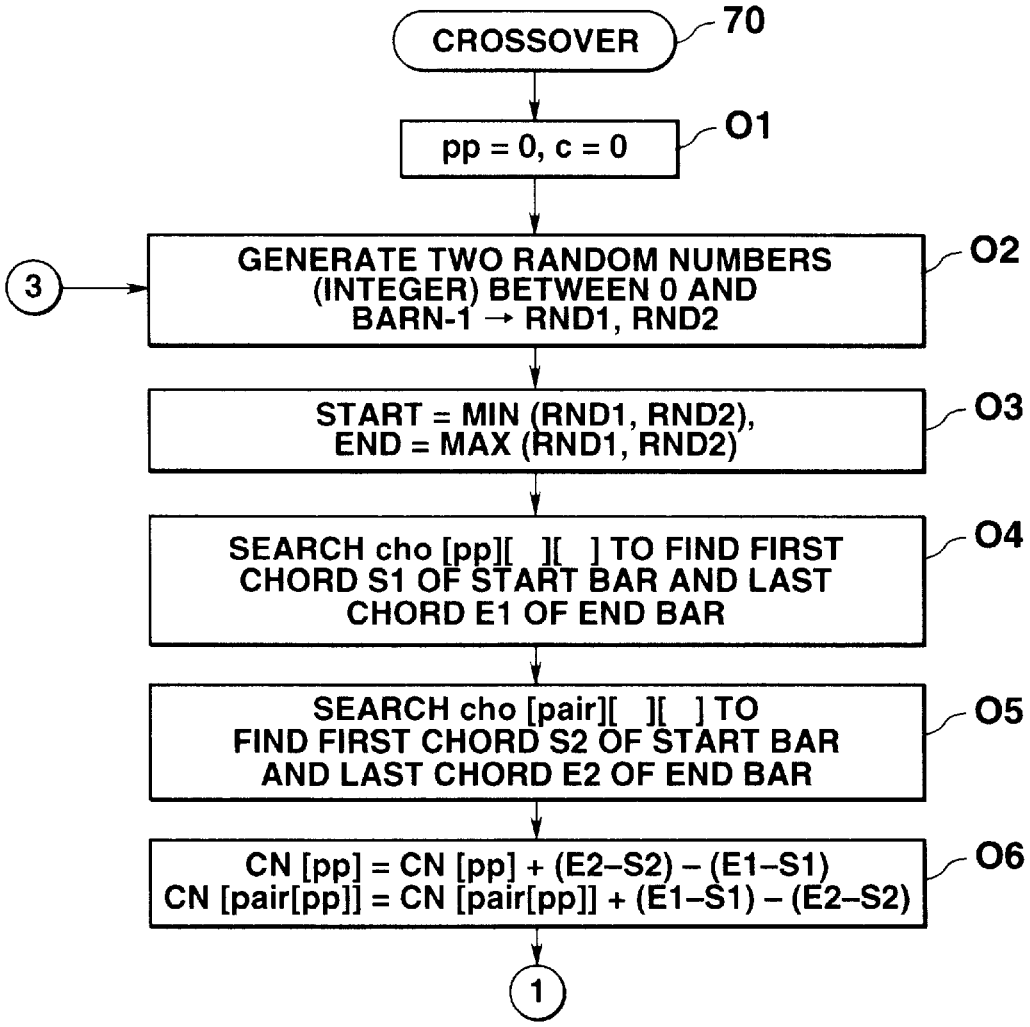
FIGS. 19 to 21 are flow charts showing a crossover routine adapted to a variable chord length system.
Figure 20:
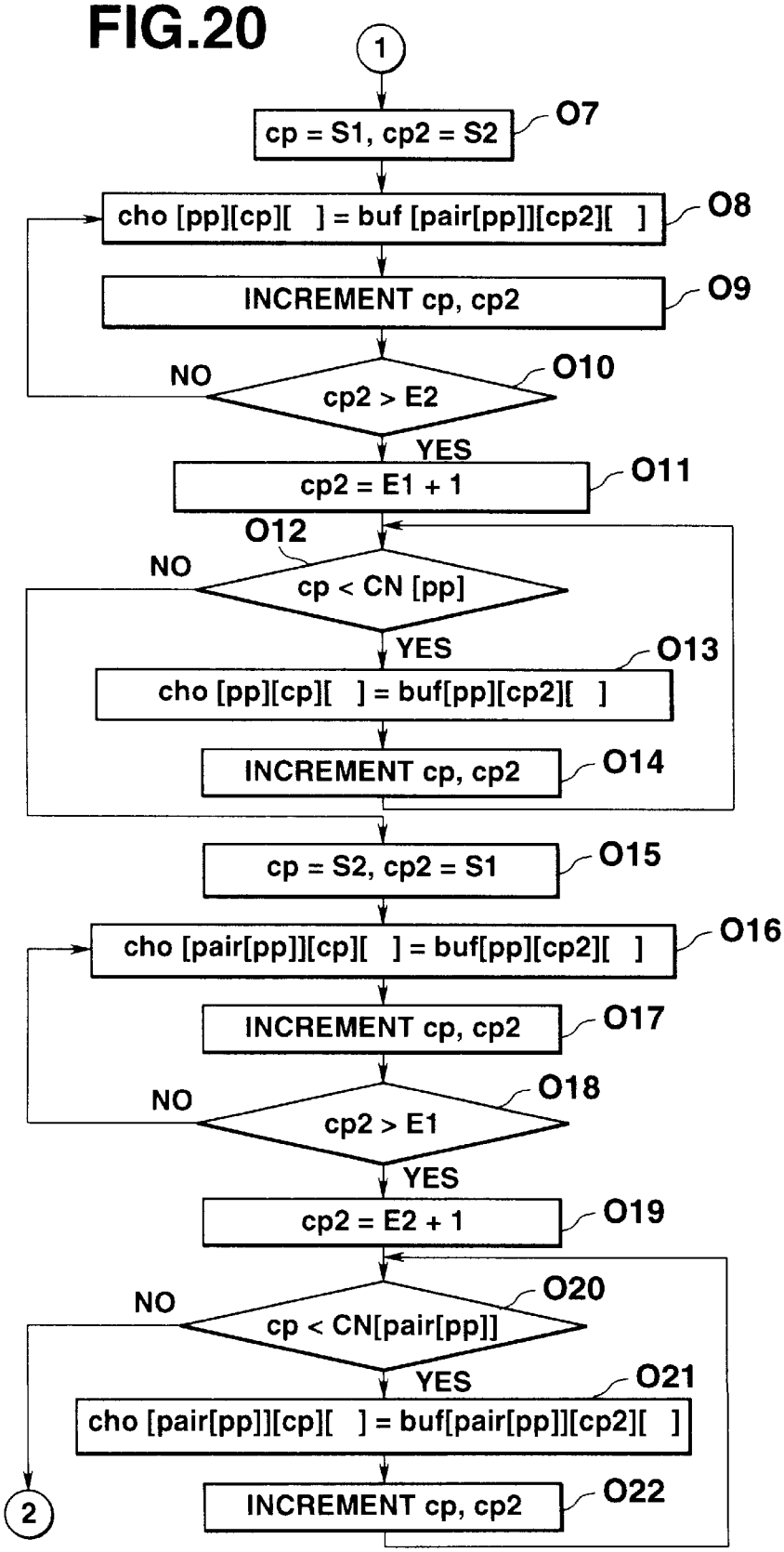
Figure 21:
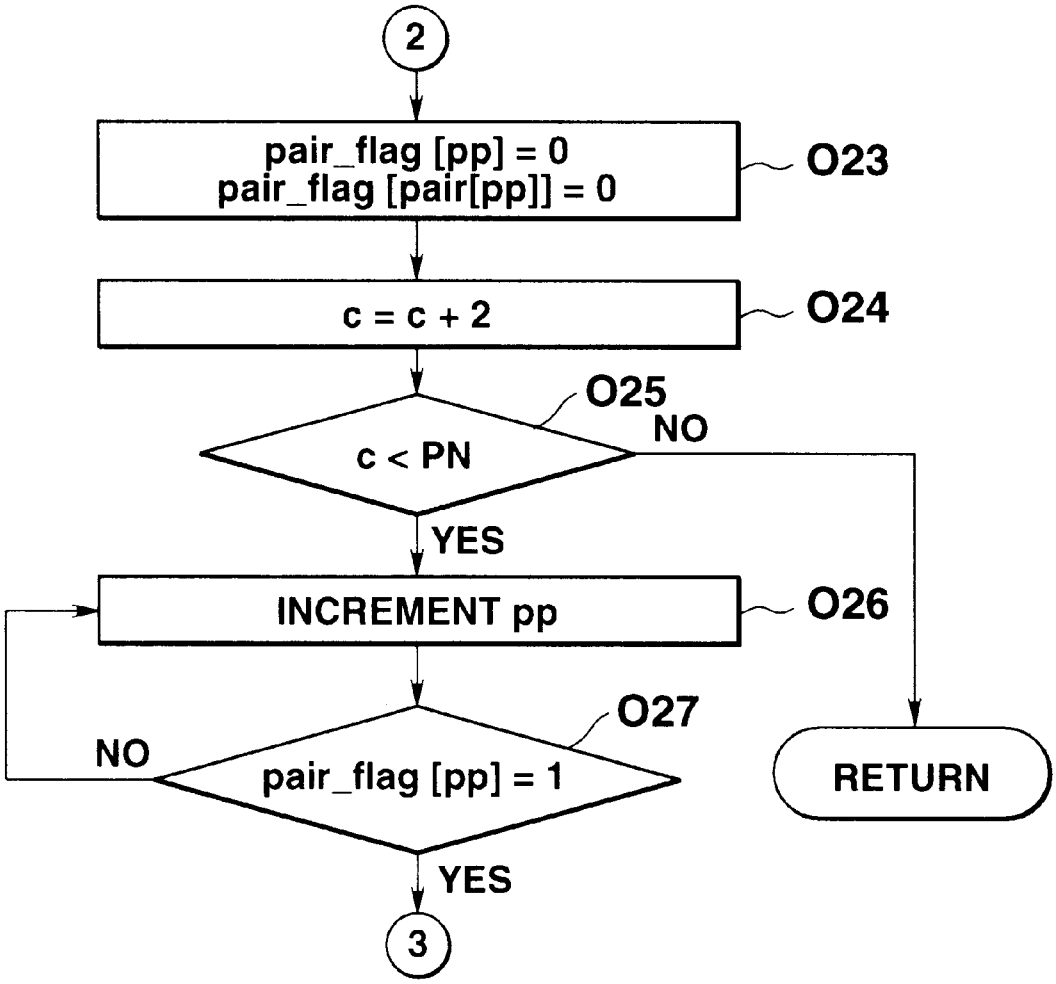

FIGS. 19 to 21 illustrates the routine, designated 70.

The crossover routine of FIGS. 19 to 21 is used in a variable chord length system whereas the crossover routine of FIG. 10 is used in a fixed chord length system.

In the routine 70 of FIGS. 19 to 21, the crossover is performed on a bar-by-bar basis, and ranges between START and END bars.

At first, the routine initializes the chord progression pointer pp and the counter c (here, for counting chord progressions which have undergone crossover) to "0" (O1). Then, it generates two random numbers (integer) RND 1 and RND 2 between 0 and BARN−1 (O2), selects the minimum of the random numbers as the start bar START of the crossover and selects the maximum as the end bar END of the crossover (O3). The start bar START can happen to coincide with the END bar.

The block O4 searches a reference chord progression cho [pp] [ ] [ ] and finds a first chord S1 of the START bar and a last chord E1 of the END bar. The block O5 searches a counterpart chord progression cho [pair [pp]] [ ] [ ] to locate a first chord S2 of the START bar and a last chord E2 of the END bar.

Block O6 computes as:

$$\mathrm{CN}[pp]=\mathrm{CN}[pp]+(E2-S2)-(E1-S1)$$

and $$\mathrm{CN}[\mathrm{pair}[pp]]=\mathrm{CN}[\mathrm{pair}[pp]]+(E1-S1)-(E2-S2).$$

The CN[pp] now represents the number of chords of the chord progression pp after the crossover, and CN[pair[pp]] represents the number of chords of the chord progression pair [pp] after the crossover.

Blocks O7 to O14 gets and loads the results of the crossover of the chord progression pp into cho [pp] [ ] [ ], using the buffer.

To this end, the blocks O7 to O11 gets a first portion of the crossed-over chord progression pp by transferring buf [pair[pp]] [cp2] [ ] to cho [pp] [cp] [ ] for cp2=S2 to E2 and for cp=S1 to (S1+E2−S2).

A second portion of the crossed-over chord progression pp has been saved in the buffer buf [pp] [cp2] [ ] for cp2=E1+1 and the following locations. While incrementing cp2 and cp, the routine transfers buf [pp] [cp2] [ ] to cho [pp] [cp] [ ] until cp reaches CN [pp] (O11 to O14), thus, getting the second portion of the crossed-over chord progression pp.

When the block finds cp=CN [pp], the crossed-over chord progression pp is completed in the memory cho [pp] [ ] [ ].

Similarly, blocks O15 to O22 gets the crossed-over chord progression pair [pp] into cho [pair[pp]] [cp] [ ], using the buffer.

Then, the routine executes the block O23 to O29. These blocks O23 to O29 are essentially identical with blocks G9 to G13 in FIG. 10.

The crossover routine of FIG. 17 (for crossover of chord progression pairs that have been selected according to melody fitness) may readily be modified so as to adapt to a variable chord length system.

This concludes the detailed description of preferred embodiments. Various modification will be obvious to those skilled in the art in accordance with the invention.

In order, for example, to effectively increase melody fitness of a chord progression population with generations, chord progression individuals of a generation may be evaluated on a segment-by-segment (e.g., bar-by-bar or phrase-by-phrase) basis to get a melody fitness valuation for respective segments, as each_val [pp][bar]. A segment of a chord progression individual having a lower melody fitness valuation may be replaced with a corresponding segment of another chord progression individual having a higher melody fitness valuation.

Therefore, the scope of the invention should be limited solely by the appended claims.

What is claimed is:

1. An apparatus for composing a chord progression for music harmonization, comprising:

(A) melody providing means for providing a melody;

(B) initial chord progression population providing means for providing a plurality of chord progressions as chord progression population of initial generation;

(C) chord progression evolving means and for repeatedly generating a new generation chord progression population from an old generation one which starts with said initial generation;

(D) said chord progression evolving means comprising (i) chord progression evaluating means for evaluating individual chord progressions of a chord progression population of interest for said melody according to a predetermined function to thereby determine a melody fitness valuation thereof, and (ii) genetic operations means for performing generic operations on said chord progression population of interest so that said melody fitness valuation will generally get higher with generations changing from older to newer; and (E) stopping means for stopping the operation of said chord progression evolving means when a predetermined terminating condition is met.

2. The apparatus of claim 1 wherein said genetic operations means comprises chord progression crossover means for exchanging chord progression segments between chord progression individuals of said chord progression population of interest.

3. The apparatus of claim 2 wherein said genetic operations means further comprises chord progression replacing means for receiving the resultant chord progression population from said chord progression crossover means and for replacing a chord progression individual having a lower melody fitness valuation with a chord progression individual of a higher melody fitness valuation.

4. The apparatus of claim 2 wherein said genetic operations means further comprises selection control means for controlling selective crossover frequency of chord progression individuals of said chord progression population of interest in such a manner that chord progression individuals are selected to undergo crossover at such a frequency as depends on melody fitness valuation thereof.

5. The apparatus of claim 1 wherein said genetic operations means comprises mutation means for mutating an element of a chord progression individual.

6. The apparatus of claim 1 wherein said stopping means comprises means for stopping the operation of said chord progression evaluating means when melody fitness valuation of said chord progression population of interest has exceeded a predetermined value.

7. A method for automatically composing a chord progression for music harmonization comprising:

(A) a providing step of providing a melody;

(B) a providing step of providing a plurality of chord progressions as chord progression population of initial generation;

(C) an evolving step of repeatedly generating a new generation chord progression population from an old generation one which starts with said initial generation;

(D) said evolving step comprising (i) evaluating chord progressions of a chord progression population of interest for said melody according to a predetermined evaluating function to thereby determine a melody fitness valuation thereof, and (ii) performing genetic operations on said chord progression population of interest so that said melody fitness valuation will generally get higher with generations changing from older to newer; and (E) a stopping step of stopping said evolving step when a predetermined terminating condition is met.

8. A method for automatically composing a chord progression for music harmonization comprising:

(A) a providing step of providing a melody;

(B) a providing step of providing a plurality of chord progressions as chord progression population of initial generation;

(C)a conditioning step of providing conditioning parameters;

(D) an evaluating step of evaluating fitness of individual chord progressions of a population of interest for said melody based on said conditioning parameters;

(E) a genetic step of performing genetic operations on said population of interest (starting with the initial generation) based on results of said evaluating to thereby generate a new generation of chord progression population; and (F) a repeating step of repeating said evaluating step and said genetic step until a predetermined terminating condition is met.

* * * * *